US007936325B2

(12) United States Patent
Miyata

(10) Patent No.: US 7,936,325 B2
(45) Date of Patent: May 3, 2011

(54) DISPLAY DEVICE, LIQUID CRYSTAL MONITOR, LIQUID CRYSTAL TELEVISION RECEIVER, AND DISPLAY METHOD

(75) Inventor: Hidekazu Miyata, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 847 days.

(21) Appl. No.: 11/886,227

(22) PCT Filed: Feb. 28, 2006

(86) PCT No.: PCT/JP2006/303781

§ 371 (c)(1),
(2), (4) Date: Sep. 13, 2007

(87) PCT Pub. No.: WO2006/098148

PCT Pub. Date: Sep. 21, 2006

(65) Prior Publication Data

US 2009/0121994 A1 May 14, 2009

(30) Foreign Application Priority Data

Mar. 15, 2005 (JP) ..... 2005-073966

(51) Int. Cl.
*G09G 3/36* (2006.01)

(52) U.S. Cl. ..... 345/89; 345/87; 345/690

(58) Field of Classification Search ..... 345/77, 345/83, 87, 89, 690
See application file for complete search history.

(56) References Cited

U.S. PATENT DOCUMENTS 5,847,688 A 12/1998 Ohi et al.
6,466,225 B1 10/2002 Larkin et al.
2001/0040546 A1* 11/2001 Ohmuro et al. ..... 345/87
2002/0003520 A1* 1/2002 Aoki ..... 345/87
2002/0149598 A1 10/2002 Greier et al.
2003/0006952 A1* 1/2003 Hong ..... 345/89
2004/0155847 A1* 8/2004 Taoka et al. ..... 345/87
2004/0239698 A1 12/2004 Kamada et al.
2005/0184944 A1 8/2005 Miyata et al.
2005/0276088 A1 12/2005 Moon et al.
2006/0290626 A1 12/2006 Arimoto et al.

FOREIGN PATENT DOCUMENTS

CN 1658269 8/2005
EP 1 564 714 8/2005
GB 2 387 955 8/2002

(Continued)

OTHER PUBLICATIONS

"New Color Science Handbook: Second Edition" University of Tokyo Press, published Jun. 10, 1998.

*Primary Examiner* — Amare Mengistu
*Assistant Examiner* — Koosha Sharifi
(74) *Attorney, Agent, or Firm* — Harness, Dickey & Pierce, P.L.C.

(57) ABSTRACT

In one embodiment of the present invention, a display device is disclosed wherein if a frame luminance is less than a maximum value, the device creates a difference between luminance outputs in the two subframes and sets the luminance difference to a value less than a sub-maximum luminance which is a maximum luminance output in one subframe. With the arrangement, no complete switching of the subframes in which luminance outputs are made occurs at a grayscale level where low luminance replaces high luminance or vice versa. Thus, the grayscale level-luminance curve continues smoothly.

6 Claims, 18 Drawing Sheets

FOREIGN PATENT DOCUMENTS

| | | |
|---|---|---|
| JP | 03-251818 | 11/1991 |
| JP | 05-68221 | 3/1993 |
| JP | 7-121144 | 5/1995 |
| JP | 07-294881 | 11/1995 |
| JP | 10-161600 | 6/1998 |
| JP | 2000-29442 | 1/2000 |
| JP | 2001-296841 | 10/2001 |
| JP | 2002-23707 | 1/2002 |
| JP | 2004-240317 | 8/2004 |
| JP | 2004-525402 | 8/2004 |
| JP | 2004-302270 | 10/2004 |
| JP | 2005-234552 | 9/2005 |
| JP | 2005-241932 | 9/2005 |
| JP | 2005-352483 | 12/2005 |
| WO | WO 02/059685 | 8/2002 |
| WO | WO 2005/038766 | 4/2005 |

* cited by examiner

DISPLAY DEVICE, LIQUID CRYSTAL MONITOR, LIQUID CRYSTAL TELEVISION RECEIVER, AND DISPLAY METHOD

TECHNICAL FIELD

The present invention relates to display devices which display images by dividing each frame into two subframes: the first and second subframes.

BACKGROUND ART

An increasing number of liquid crystal displays, especially, color liquid crystal displays with a TN (Twisted Nematic) liquid crystal display panel (TN-mode liquid crystal panel, TN panel) are being used in recent years in what has been traditionally the fields for CRTs (cathode ray tubes).

For example, Patent Document 1 discloses a liquid crystal display switching between TN panel driving methods according to whether the display image is a moving image or a still image.

These TN panels have some problems associated with viewing angle characteristics when compared to CRTs.

Grayscale characteristics change with an increasing line-of-sight angle (angle at which the panel is viewed; angle between the normal to the panel and the direction in which the panel is viewed). At some angles, grayscale inversion may occur.

Techniques have been accordingly developed which improve viewing angle characteristics using an optical film and also which mitigate grayscale inversion by modifying a display method. For example, Patent Documents 2 and 3 disclose a method whereby each frame is divided to write a signal to one pixel more than once and another in which signal write voltage levels are combined for improvement.

The viewing angle of TVs (television receivers) and other liquid crystal display panels which require wide viewing angles is increased by using liquid crystal of IPS (In-plane Switching) mode, VA (Vertical Alignment) mode, or like mode, instead of TN mode. For example, a VA-mode liquid crystal panel (VA panel) shows a contrast of 10 or greater within 170° up/down/left/right and is free from grayscale inversion.

Patent Document 1: Japanese Unexamined Patent Publication (Tokukai) 2001-296841 (published Oct. 26, 2001)

Patent Document 2: Japanese Unexamined Patent Publication 5-68221/1993 (Tokukaihei 5-68221; published Mar. 19, 1993)

Patent Document 3: Japanese Unexamined Patent Publication (Tokukai) 2002-23707 (published Jan. 25, 2002)

Non-patent Document 1: New Handbook for Color Science, Second Edition (Tokyo University Press; published Jun. 10, 1998)

DISCLOSURE OF INVENTION

However, even VA panels, reputed to have a wide viewing angle, cannot completely prevent grayscale characteristics from changing with the viewing angle. Their grayscale characteristics deteriorate, for example, at large viewing angles in left and right directions.

Specifically, as shown in FIG. 2, grayscale γ-characteristics at 60° viewing angle differ from those when the panel is viewed from the front (that is, viewing angle=0°). That leads to an excess brightness phenomenon in which halftone luminance becomes excessively bright.

Liquid crystal panels of IPS mode have similar problems. Grayscale characteristics may change with an increasing viewing angle, albeit on a different scale, depending on the design of optical films and other optical properties.

The present invention, conceived to address these conventional problems, has an objective of providing a display device capable of mitigating the excess brightness phenomenon.

The display device of the present invention (present display device) is, to achieve the objective, adapted as follows. The display device displays an image by dividing each frame into two subframes, i.e., a first subframe and a second subframe, the display device including: a display section displaying an image with luminance in accordance with a luminance grayscale level represented by an incoming display signal; and a control section generating a first display signal and a second display signal for the first and second subframes for output to the display section so that the dividing of the frames does not change a frame luminance which is a sum luminance output of the display section in one frame, wherein if the frame luminance is less than a maximum value, the control section creates a difference between luminance outputs in the two subframes and sets the luminance difference to a value less than a sub-maximum luminance which is a maximum luminance output in one subframe.

The present display device displays an image on a display section with a display screen (e.g., a liquid crystal panel).

The present display device is adapted so that the control section drives the display section by subframe display. Subframe display is a display scheme whereby each frame is divided into plural (two in the present display device) subframes (first and second subframes).

In other words, the control section outputs a display signal to the display section twice per frame period (outputs the first display signal for the first subframe and the second display signal for the second subframe).

Accordingly, the control section turns on all the gate lines of the display screen in the display section once every two subframe periods (twice per frame). All the gate lines of the display screen are turned on only once per frame period in an ordinary display scheme whereby no frame is divided into subframes (ordinary hold display).

The display section (display screen) is designed to display an image with luminance in accordance with a luminance grayscale level represented by a display signal supplied from the control section.

The control section is adapted to generate the first and second display signals (specify the luminance grayscale levels represented by the display signals) so as to prevent the dividing of the frames from leading to a change in the sum luminance (frame luminance) output of the screen in each frame.

Generally, with the display screen in the display section, discrepancy between the actual luminance and the expected luminance (luminance discrepancy) at large viewing luminance can be reduced as the image luminance approaches a minimum or a maximum.

The expected luminance is the expected luminance output of the display screen (value in accordance with the luminance grayscale level represented by the display signal). The actual luminance is the actual luminance output of the screen and variable with viewing angle. Viewing the screen from the front, the actual luminance is equal the expected luminance.

In the present display device, the control section is designed to create a difference between luminance outputs in the two subframes if the frame luminance is less than a maximum value (in the case of not completely white display).

Accordingly, with the present display device, the luminance in either one of the subframes approaches a minimum or a maximum when compared to the same luminance being output in the two subframes (corresponding to ordinary hold display).

Thus, the present display device reduces the luminance discrepancy in each frame, hence mitigates the excess brightness phenomena caused by the discrepancy, when compared to a structure for ordinary hold display.

The same subframe display is capable of also improving the display quality of moving images.

More specifically, if one follows the motion of an object being displayed by ordinary hold display with his/her eyes, he/she would perceive at the same time the color and brightness of the immediately preceding frame. That results in the viewer perceiving blurred object edges.

In contrast, when producing a moving image by subframe display (especially, at low luminance), the luminance in one of the subframes in each frame is low. The low luminance subframe restrains visual mixing of the currently perceiving frame image and the immediately preceding frame image (color, brightness). The edge blurring is thereby prevented, improving the display quality of moving images.

To best prevent the luminance discrepancy, if the frame luminance is less than or equal to the sub-maximum luminance (maximum luminance output in one subframe) (in a low luminance case), the device preferably designates one of the subframes for black display and adjusts luminance for the other subframe to produce a display.

When the subframe periods are 1:1, the sub-maximum luminance is half the maximum value of the frame luminance.

If the frame luminance is greater than the sub-maximum luminance (in a high luminance case), the device preferably designates the other subframe for white display and adjusts luminance for the one of the subframe to produce a display. Accordingly, the luminance discrepancy in either one of the subframes becomes 0.

The relationship between the grayscale level and the luminance of the display section is in accordance with its response characteristics (value of $\gamma$) and does not change from one subframe to the next. A relative increase in the luminance with respect to an increase in the grayscale level (rate of increase) is generally small when the luminance grayscale level is low and large when the luminance grayscale level is high.

Therefore, with subframe display to best prevent the luminance discrepancy, a complete switching of subframes in which luminance outputs are made occurs at a grayscale level where low luminance replaces high luminance or vice versa (switching grayscale level; corresponding to the sub-maximum luminance).

The rate of increase of the luminance with respect to increase of the grayscale level changes greatly, creating an inflection point (singular point) on the grayscale level-luminance curve (see Best Mode for Carrying out the Invention below for details).

To restrain occurrence of the inflection point, the present display device sets the difference between the luminances in the two subframes to a value less than the sub-maximum luminance which is a maximum luminance output in one subframe.

The setting allows the luminances in the two subframes to increase (both the luminance with a high rate of increase and the luminance with a low rate of increase to increase) in accordance with an increase in the grayscale level at least near the sub-maximum luminance (switching grayscale level). That in turn restrains occurrence of an inflection point near the sub-maximum luminance (switching grayscale level).

In the present display device, if the frame luminance is less than or equal to a predetermined threshold, the control section preferably designates one of the subframes for black display and adjusts the luminance of the other subframe to produce a display.

If the frame luminance is greater than the threshold, the device preferably sets the difference between the luminance outputs in the two subframes to a value less than the sub-maximum luminance. The threshold is less than the sub-maximum luminance.

Thus, the present display device assigns one subframe for black display if the frame luminance is low (less than or equal to a threshold which is less than the sub-maximum luminance), that is, if there occurs no inflection point. Therefore, the luminance discrepancy is reduced.

As the threshold is reduced so that it moves away from the luminance in accordance with the switching grayscale level (sub-maximum luminance), the inflection point is restrained better. In contrast, if the threshold is reduced in excess, excess brightness in subframe display is not well reduced at low frame luminance.

Accordingly, the present display device preferably sets the threshold to a luminance range in accordance with luminance grayscale levels from 50% or more to 98% or less of a luminance grayscale level in accordance with the sub-maximum luminance.

With the threshold being set to this range, inflection point occurrence is well restrained while excess brightness reduction is maintained.

According to the structure, there are luminance outputs in the two subframes when the frame luminance is greater than the threshold. If the difference between the luminances in the two subframes is reduced in excess, the subframe display is not as effective in reducing excess brightness until the luminance in one of the subframes reaches the sub-maximum luminance (white display). If the luminance difference is too large, inflection point occurrence is not well restrained.

Accordingly, the present display device preferably sets the difference between the luminances in the two subframes to a luminance range in accordance with luminance grayscale levels from 50% or more to 98% or less of a luminance grayscale level in accordance with the sub-maximum luminance, similarly to the threshold.

With the difference between the luminances in the two subframes being set to this range, inflection point occurrence is well restrained while excess brightness is reduction is maintained.

A combination of the present display device including the display section provided by the liquid crystal panel and an image signal feeder section (signal feeder section) provides a liquid crystal monitor for personal computers and other uses.

The image signal feeder section is for transferring externally supplied image signals to the control section.

In the structure, the control section in the present display device generates the display signals from the image signals fed from the image signal feeder section, for output to the display section.

A combination of the present display device including the display section provided by the liquid crystal panel and a tuner section provides a liquid crystal television receiver.

The tuner section is for selecting a channel for television broadcast signals and transferring the selected channel's television image signals to the control section.

In the structure, the control section in the present display device generates the display signals from the television image signals fed from the tuner section, for output to the display section.

The method of displaying an image of the present invention (present display method) displays an image by dividing each frame into two subframes, i.e., a first subframe and a second subframe, the display method involving the step of generating a first display signal and a second display signal for the first and second subframes for output to a display section so that the dividing of the frames does not change a frame luminance which is a sum luminance output of the display section in one frame, wherein if the frame luminance is less than a maximum value, the step creates a difference between luminance outputs in the two subframes and sets the luminance difference to a value less than a sub-maximum luminance which is a maximum luminance output in one subframe.

The present display method is used with the present display device. Therefore, the display method causes small luminance discrepancy when compared to ordinary hold display, thereby improving viewing angle characteristics. That well mitigates excess brightness phenomena and improves the display quality of a moving image.

Furthermore, the setting of the luminance difference between the subframes to a value less than the sub-maximum luminance prevents an inflection point (singular point) from occurring on the grayscale level-luminance curve.

As described in the foregoing, the display device of the present invention (present display device) displays an image by dividing each frame into two subframes, i.e., a first subframe and a second subframe and includes a display section and a control section. The display section displays an image with luminance in accordance with a luminance grayscale level represented by an incoming display signal. The control section generates a first display signal and a second display signal for the first and second subframes for output to the display section so that the dividing of the frames does not change a frame luminance which is a sum luminance output of the display section in one frame. If the frame luminance is less than a maximum value, the control section creates a difference between luminance outputs in the two subframes and sets the luminance difference to a value less than a sub-maximum luminance which is a maximum luminance output in one subframe.

In the present display device, the control section is designed to create a difference between luminance outputs in the two subframes if the frame luminance is less than a maximum value (in the case of not completely white display).

Accordingly, with the present display device, the luminance in either one of the subframes approaches a minimum or a maximum when compared to the same luminance being output in the two subframes (corresponding to ordinary hold display).

Thus, the present display device reduces luminance discrepancy in each frame, hence mitigating the excess brightness phenomena caused by the discrepancy, when compared to a structure for ordinary hold display.

The same subframe display is capable of also improving the display quality of moving images.

More specifically, if one follows the motion of an object being displayed by ordinary hold display with his/her eyes, he/she would perceive at the same time the color and brightness of the immediately preceding frame. That results in the viewer perceiving blurred object edges.

In contrast, when producing a moving image by subframe display (especially, at low luminance), the luminance in one of the subframes in each frame is low. The low luminance subframe restrains visual mixing of the currently perceiving frame image and the immediately preceding frame image (color, brightness). The edge blurring is thereby prevented, improving the display quality of moving images.

The present display device sets the difference between the luminances in the two subframes to a value less than the sub-maximum luminance which is a maximum luminance output in one subframe.

The setting allows the luminances in the two subframes to increase (both the luminance with a high rate of increase and the luminance with a low rate of increase to increase) in accordance with an increase in the grayscale level at least near the sub-maximum luminance (switching grayscale level). That in turn restrains occurrence of an inflection point near the sub-maximum luminance (switching grayscale level).

Additional objects, advantages and novel features of the invention will be set forth in part in the description which follows, and in part will become apparent to those skilled in the art upon examination of the following or may be learned by practice of the invention.

BRIEF DESCRIPTION OF DRAWINGS

FIG. 9(*b*) An illustration of a method whereby the polarity of an electrode-to-electrode voltage is reversed at a frame cycle.

FIG. 10(*b*) An illustration depicting the response rate of liquid crystal.

FIG. 10(*c*) An illustration depicting the response rate of liquid crystal.

FIG. 12(*b*) A graph representing transitioning of a liquid crystal driving voltage (that is, voltage applied to liquid crystal) of which the polarity is reversed at a subframe cycle.

FIG. 13(*b*) An illustration of a method whereby the polarity of an electrode-to-electrode voltage is reversed at a frame cycle.

FIG. 14(*b*) An illustration showing four pixels in a liquid crystal panel and the polarities of liquid crystal driving voltages for the pixels.

FIG. 14(*c*) An illustration showing four pixels in a liquid crystal panel and the polarities of liquid crystal driving voltages for the pixels.

FIG. 14(*d*) An illustration showing four pixels in a liquid crystal panel and the polarities of liquid crystal driving voltages for the pixels.

BEST MODE FOR CARRYING OUT INVENTION

The following will describe an embodiment of the present invention.

A liquid crystal display of the present embodiment (present display device) has a liquid crystal panel of vertical alignment (VA) mode divided into a plurality of domains. The present display device functions as a liquid crystal monitor producing a display on a liquid crystal panel from externally supplied image signals.

Figure 1:
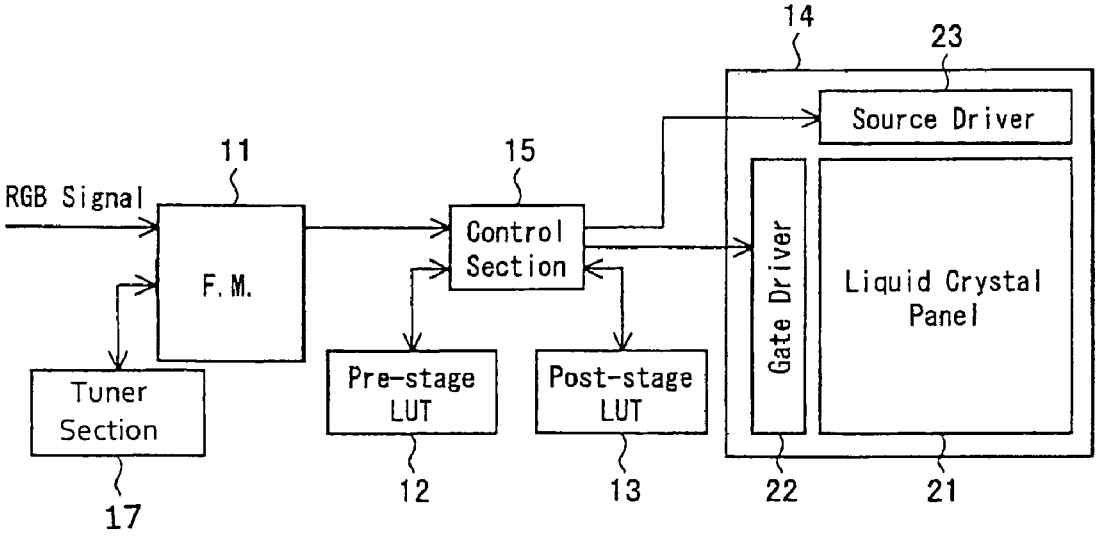
FIG. 1 A block diagram illustrating the structure of a display device in accordance with an embodiment of the present invention.

FIG. 1 is a block diagram illustrating the internal structure of the present display device. As shown in FIG. 1, the present display device includes a frame memory (F.M.) 11, a pre-stage LUT 12, a post-stage LUT 13, a display section 14, and a control section 15.

The frame memory (image signal feeder section) 11 stores a frame of image signals (RGB signals) fed from an external signal source. The pre-stage LUT (look-up table) 12 and the post-stage LUT 13 is an association table (conversion table) between external image signal inputs and display signal outputs to the display section 14.

The present display device is adapted to carry out subframe display. Subframe display is a method of producing a display by dividing each frame into a plurality of subframes.

In other words, the present display device is designed to produce a display from a frame of image signals fed in one frame period, by means of two subframes of the same size (period) at double the frequency.

The pre-stage LUT 12 is an association table for display signal outputs made in a pre-stage subframe (preceding subframe). That display signal may be referred to as the pre-stage display signal. The post-stage LUT 13 is an association table for display signal outputs made in a post-stage subframe (succeeding subframe). That display signal may be referred to as the post-stage display signal.

The display section 14 includes a liquid crystal panel 21, a gate driver 22, and a source driver 23 as shown in FIG. 1. The display section 14 produces an image display from incoming display signals. The liquid crystal panel 21 is an active matrix (TFT) liquid crystal panel of VA mode.

The control section 15 is a central processing unit of the present display device, controlling all operations in the present display device. The control section 15 generates display signals from the image signals stored in the frame memory 11 using the pre-stage LUT 12 and the post-stage LUT 13 and supplies the signals to the display section 14.

In other words, the control section 15 records the image signals that are incoming at an ordinary output frequency (ordinary clock; for example, 25 MHz) into the frame memory 11. The control section 15 then outputs twice the image signals from the frame memory 11 in accordance with a clock with double the frequency of the ordinary clock (double clock; 50 MHz).

The control section 15 generates pre-stage display signals from first image signal outputs using the pre-stage LUT 12. Thereafter, the control section 15 generates post-stage display signals from second image signal outputs using the post-stage LUT 13. The display signals are fed to the display section 14 in a sequential manner in accordance with the double clock.

Accordingly, the display section 14 displays, once in every frame period, different images from the two sequentially fed display signals (all the gate lines of the liquid crystal panel 21 are turned on once in each of the two subframe periods). Display signal output operation will be described later in more detail.

Next will be described the generation of the pre-stage display signals and the post-stage display signals by the control section 15. First, the following will describe typical display luminance (luminance of an image display produced on a panel) in relation with the liquid crystal panel.

When an image is displayed from ordinary 8-bit data over a single frame, without using subframes (ordinary hold display in which all the gate lines of the liquid crystal panel are turned on only once in every frame period), a display signal represents luminance grayscale levels (signal grayscale levels) 0 to 255.

The signal grayscale levels and the display luminance of a liquid crystal panel are related approximately by equation 1 below:

$$((T-T0)/(T\max-T0))=(L/L\max)\wedge\gamma \quad (1)$$

where L is a signal grayscale level in ordinary hold display in which an image is displayed over a frame (frame grayscale level), Lmax is a maximum luminance grayscale level (=255), T is a display luminance, Tmax is a maximum luminance (luminance when L=Lmax=255; white), T0 is a minimum luminance (luminance when L=0; black), and γ is a correction value (typically, 2.2).

In the case of an actual liquid crystal panel 21, T0≠0. Let us assume in the following, however, that T0=0 for simple description.

Figure 2:
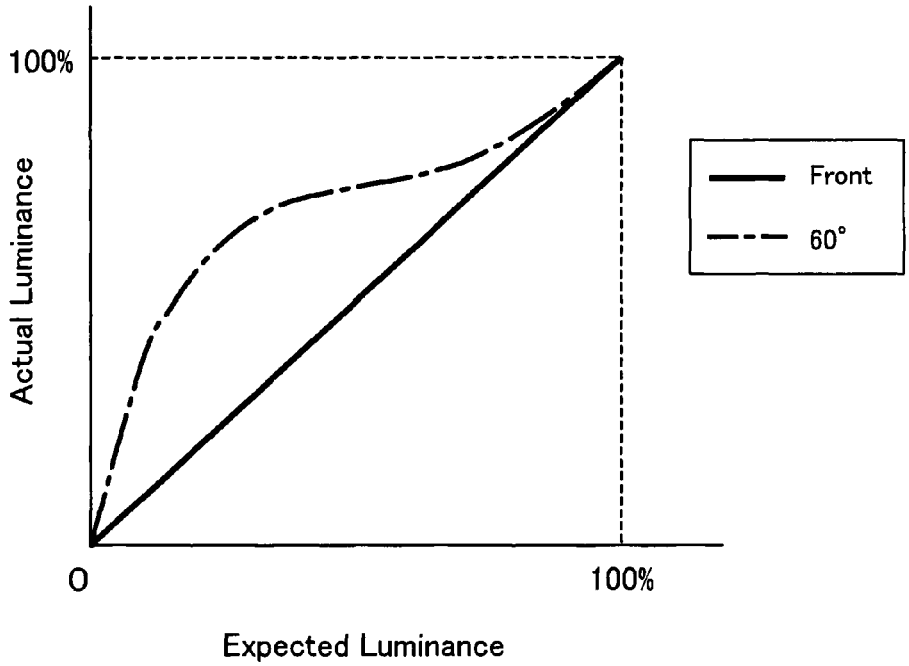
FIG. 2 A graph representing display luminance outputs of a liquid crystal panel (relationship between expected luminance and actual luminance) for ordinary hold display.

The display luminance T output of the liquid crystal panel 21 in the above case (ordinary hold display) is drawn in the graph in FIG. 2. In the graph, the expected luminance output (expected luminance; value in accordance with a signal grayscale level, equivalent to the display luminance T) is plotted on the horizontal axis. The actual luminance output (actual luminance) is plotted on the vertical axis.

As can be seen from the graph, in this case, the two luminances are equal to each other when the liquid crystal panel 21 is viewed from the front (that is, viewing angle=0°). In contrast, when the viewing angle is set to 60°, the actual luminance increases at halftone luminance due to changes in grayscale γ-characteristics.

Next, the display luminance of the present display device will be described. In the present display device, the control section 15 is designed to with such grayscale display capability that it can satisfy conditions (a) and (b):

(a) The total sum of the luminances (display luminances) of the images displayed by the display section 14 in the individual preceding and succeeding subframes (integral luminance over one frame) equals the display luminance over one frame in ordinary hold display; and (b) One of the subframes is either black (minimum luminance) or white (maximum luminance).

To achieve this, the present display device is designed so that the control section 15 can equally divide a frame into two subframes in one of which the display luminance reaches half a maximum luminance.

In other words, in a case where the luminance reaches half the maximum luminance (threshold luminance; Tmax/2) in one frame (in a low luminance case), the control section 15 designates the preceding subframe for a minimum luminance (black) and adjusts the display luminance in only the succeeding subframe (using only the succeeding subframe) to achieve a grayscale display. In a case like this, the integral luminance over one frame equals (minimum luminance+luminance in the succeeding subframe)/2.

In a case of outputting a higher luminance than the threshold luminance (in a high luminance case), the control section 15 designates the succeeding subframe for a maximum luminance (white) and adjusts the display luminance in the preceding subframe to achieve a grayscale display. In a case like this, the integral luminance over one frame equals (luminance in the preceding subframe+maximum luminance)/2.

Now, the following will specifically describe such signal grayscale level settings for the display signals (pre-stage display signal and post-stage display signal) that this particular display luminance is achieved.

The signal grayscale level settings are made by the control section 15 shown in FIG. 1. The control section 15 calculates in advance a frame grayscale level corresponding to the threshold luminance (Tmax/2) by equation 1.

In other words, rearranging equation 1, the frame grayscale level (threshold luminance grayscale level; Lt) which is in accordance with the display luminance is given by:

$$Lt=0.5\wedge(1/\gamma)\times L\max \quad (2)$$

When displaying an image, the control section 15 calculates the frame grayscale level L from the image signal output of the frame memory 11. If L≦Lt, the control section 15 controls the pre-stage LUT 12 to set the luminance grayscale level represented by the pre-stage display signal (termed F) to a minimum (0). Meanwhile, the control section 15 controls the post-stage LUT 13 to set the luminance grayscale level represented by the post-stage display signal (termed R) by equation 1 so that $$R=0.5\wedge(1/\gamma)\times L \quad (3)$$

If the frame grayscale level L>Lt, the control section 15 sets the luminance grayscale level represented by the post-stage display signal R to a maximum (255). Meanwhile, the control section 15, using equation 1, sets the luminance in the preceding subframe grayscale level F to:

$$F=(L\wedge\gamma-0.5\times L\max\wedge\gamma)\wedge(1/\gamma) \quad (4)$$

Next, display signal output operation by the present display device will be described in more detail. In the following, the liquid crystal panel 21 is assumed to have a×b pixels.

In a case like this, the control section 15 stores in the source driver 23 the pre-stage display signals for the a pixels on the first gate lines in accordance with the double clock.

The control section 15 controls the gate driver 22 to turn on the first gate lines to write a pre-stage display signal to the pixels on the gate lines. Thereafter, The control section 15 similarly turns on the second to b-th gate lines in accordance with the double clock, while changing the pre-stage display signals to be stored in the source driver 23. Accordingly, the pre-stage display signals for all the pixels can be written within half the frame period (½ frame period).

Furthermore, the control section 15 performs a similar operation to write a post-stage display signal to the pixels on all the gate lines within the remaining half of the frame period. Accordingly, a pre-stage display signal and a post-stage display signal are written to each pixel taking up equal times (=½ frame period).

Figure 3:
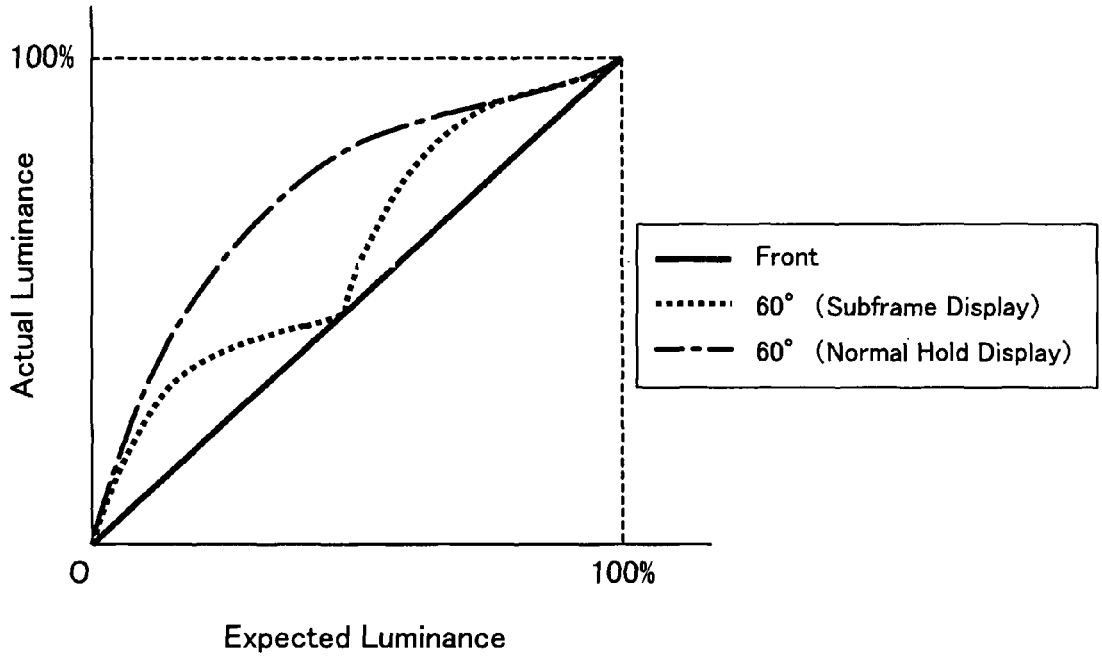
FIG. 3 A graph representing display luminance outputs of a liquid crystal panel (relationship between expected luminance and actual luminance) for subframe display on the display device shown in FIG. 1.

FIG. 3 is a graph representing results of such subframe display (broken line and solid line) in which the pre-stage display signal outputs and the post-stage display signal outputs are divided between the preceding and succeeding subframes, together with the results (dash-dot line and solid line) shown in FIG. 2.

The present display device uses a liquid crystal panel 21 in which, as shown in FIG. 2, the discrepancy of the actual luminance from the expected luminance (equivalent to the solid line) at large viewing angles is a minimum (0) when the display luminance is either a minimum or a maximum and a maximum at halftones (threshold luminance proximity).

The present display device performs subframe display in which each frame is divided into subframes. Furthermore, the two subframes are set up to have equal durations. At low luminances, only the succeeding subframe is used to produce a display, with the preceding subframe being designated for black display, so long as the integral luminance over one frame does not change. Therefore, the discrepancy in the preceding subframe is reduced to a minimum. Thus, the total discrepancy in the two subframes can be reduced to about half as indicated by the broken line in FIG. 3.

On the other hand, at high luminances, the luminance in only the preceding subframe is adjusted to produce a display, with the succeeding subframe being designated for white display, so long as the integral luminance over one frame does not change. Therefore, the discrepancy in the succeeding subframe is reduced similarly to a minimum in this case. The total discrepancy in the two subframes can be reduced to about half as indicated by the broken line in FIG. 3.

As explained above, the present display device is capable of reducing overall discrepancy to about half that for structures for ordinary hold display (structures in which an image is displayed over a single frame, without using subframes). That reduces brightness/excess brightness in halftone images (excess brightness phenomenon) shown in FIG. 2.

In the present embodiment, the duration of the preceding subframe is made equal to that of the succeeding subframe. This is for the purpose of achieving half the maximum luminance in one subframe. The subframe durations, however, may be set to different values.

The excess brightness phenomenon, an issue to be addressed by the present display device, is a phenomenon in which a halftone luminance image appears excessively bright because of the characteristics of the actual luminance at large viewing angles as shown in FIG. 2.

Normally, an image captured on a camera is represented by luminance signals. To transmit the image in digital format, the image is converted to display signals using γ shown in equation 1 (in other words, luminance signals are raised to the (1/γ)-th power and equally divided to assign grayscale levels). The image displayed on a liquid crystal panel or like display device from these display signals has the display luminance given by equation 1.

The human eye perceives an image by brightness, not by luminance. Brightness (brightness index) M is given by equations/inequalities (5), (6) (see Non-patent Document 1):

$$M=116\times Y\wedge(1/3)-16, Y>0.008856 \quad (5)$$

$$M=903.29\times Y, Y\leqq 0.008856 \quad (6)$$

where Y is equivalent to the actual luminance explained above and given by Y=(y/yn), y denotes the y value of tristimulus values of a given color in the xyz color system, and yn denotes the y value by standard light on a total diffusing reflective face and is defined as yn=100.

The equations/inequalities indicate that the human eye tends to be sensitive to low luminance video and insensitive to high luminance video. A human being presumably perceives excess brightness as discrepancy in brightness, not discrepancy in luminance.

Figure 6:
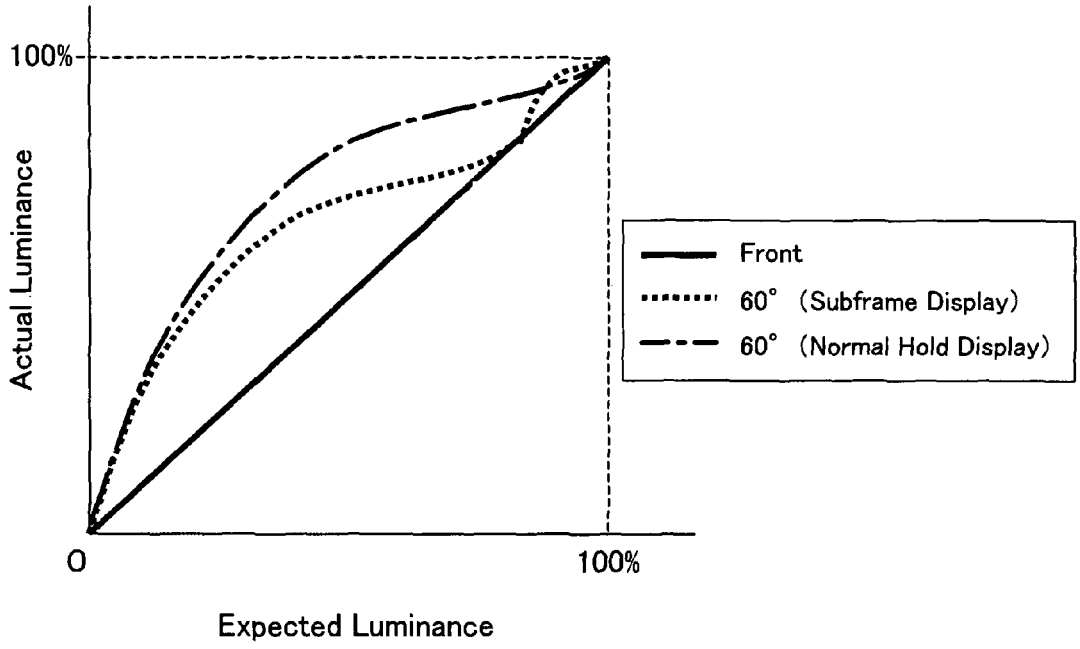
FIG. 6 A brightness graph plotted by luminance-to-brightness conversion of the luminance graph in FIG. 3.

FIG. 6 is a graph plotted by luminance-to-brightness conversion of the luminance graph in FIG. 3. In the graph, the expected brightness output (expected brightness; a value in accordance with a signal grayscale level, equivalent to the brightness M) is plotted on the horizontal axis. The actual brightness output (actual brightness) is plotted on the vertical axis. As indicated by the solid line in the graph, the two levels of brightness are equal to each other when the liquid crystal panel 21 is viewed from the front (that is, viewing angle=0°).

In contrast, as indicated by the broken line in the graph, when the viewing angle is set to 60° and the durations of all the subframes are equal (in other words, when half the maximum luminance is reached within one subframe), the discrepancy of the actual brightness from the expected brightness is improved, albeit not much, over conventional cases of ordinary hold display. That demonstrates that the excess brightness phenomenon is somewhat mitigated.

For further mitigating the excess brightness phenomenon in a manner that suits human vision, it is more preferable to determine frame division ratios in accordance with brightness, not with luminance. The discrepancy of the actual brightness from the expected brightness is a maximum when the expected brightness is half the maximum value similarly to the case of luminance.

Therefore, the discrepancy as perceived by the human eye (that is, excess brightness) is reduced better by dividing a frame so that half the maximum brightness is reached within one subframe than by dividing a frame so that half the maximum luminance is reached within one subframe.

Accordingly, the following will describe desirable values at frame dividing points. First, for ease in calculation, equations/inequalities (5), (6) introduced above are approximated by equation (6a) which is derived by combining and rearranging (5), (6). Equation (6a) has a similar form to equation 1.

$$M=Y\wedge(1/\alpha) \quad (6a)$$

In this form of the equation, α=2.5.

The luminance Y and brightness M as given in equation (6a) has a proper relationship (suitable to human vision) if a is from 2.2 to 3.0.

It is known that the durations of the two subframes is preferably about 1:3 if γ=2.2 and about 1:7 if γ=3.0 to produce a display at half the maximum brightness M in one subframe. When the frame is divided as in above, one of the subframes which is used for display when luminance is low (the one maintained at a maximum luminance in a high luminance case) is the shorter period.

The following will describe a case where the ratio of the preceding subframe and the succeeding subframe is set to 3:1. First, display luminance in the case will be described.

In this case, to produce a low luminance display in which a quarter of a maximum luminance (threshold luminance; Tmax/4) is achieved in one frame, the control section 15 designates the preceding subframe for a minimum luminance (black) and adjusts the display luminance in only the succeeding subframe to produce a grayscale display (uses only the succeeding subframe to produce a grayscale display). The integral luminance over one frame here equals (minimum luminance+luminance in the succeeding subframe)/4.

To achieve a higher luminance than the threshold luminance (Tmax/4) in one frame (in a high luminance case), the control section 15 designates the succeeding subframe for a maximum luminance (white) and adjusts the display luminance in the preceding subframe to produce a grayscale display. The integral luminance over one frame here equals (luminance in the preceding subframe+maximum luminance)/4.

Now, the following will specifically describe such signal grayscale level settings for the display signals (pre-stage display signal and post-stage display signal) that this particular display luminance is achieved. The signal grayscale levels (and output operation which will be detailed later) in this case are also set so as to meet conditions (a), (b).

First, the control section 15 calculates in advance a frame grayscale level corresponding to the threshold luminance (Tmax/4) by equation 1.

In other words, rearranging equation 1, the frame grayscale level (threshold luminance grayscale level; Lt) which is in accordance with the display luminance is given by:

$$Lt=(1/4)\wedge(1/\gamma)\times L\max \quad (7)$$

When displaying an image, the control section 15 calculates the frame grayscale level L from the image signal output of the frame memory 11. If L≦Lt, the control section 15 controls the pre-stage LUT 12 to set the luminance grayscale level represented by the pre-stage display signal (termed F) to a minimum (0).

Meanwhile, the control section 15 controls the post-stage LUT 13 to set the luminance grayscale level represented by the post-stage display signal (termed R) by equation 1 so that $$R=(1/4)\wedge(1/\gamma)\times L \quad (8)$$

If the frame grayscale level L>Lt, the control section 15 sets the luminance grayscale level represented by the post-stage display signal R to a maximum (255). Meanwhile, the control section 15, using equation 1, sets the luminance in the preceding subframe grayscale level F to:

$$F=((L\wedge\gamma-(1/4)\times L\max\wedge\gamma))\wedge(1/\gamma) \quad (9)$$

Next, the output operation for the pre-stage display signal and the post-stage display signal will be described.

As explained above, in an equal frame division structure, a pre-stage display signal and a post-stage display signal are written to each pixel over equal durations (½ frame period). This is because in order to write the post-stage display signals after all the pre-stage display signals are written in accordance with the double clock, those gate lines which are related to the display signals are turned on for equal periods.

Therefore, the division ratios can be changed by changing the timings at which to start writing the post-stage display signals (gate ON timings related to the post-stage display signals).

Figure 4:
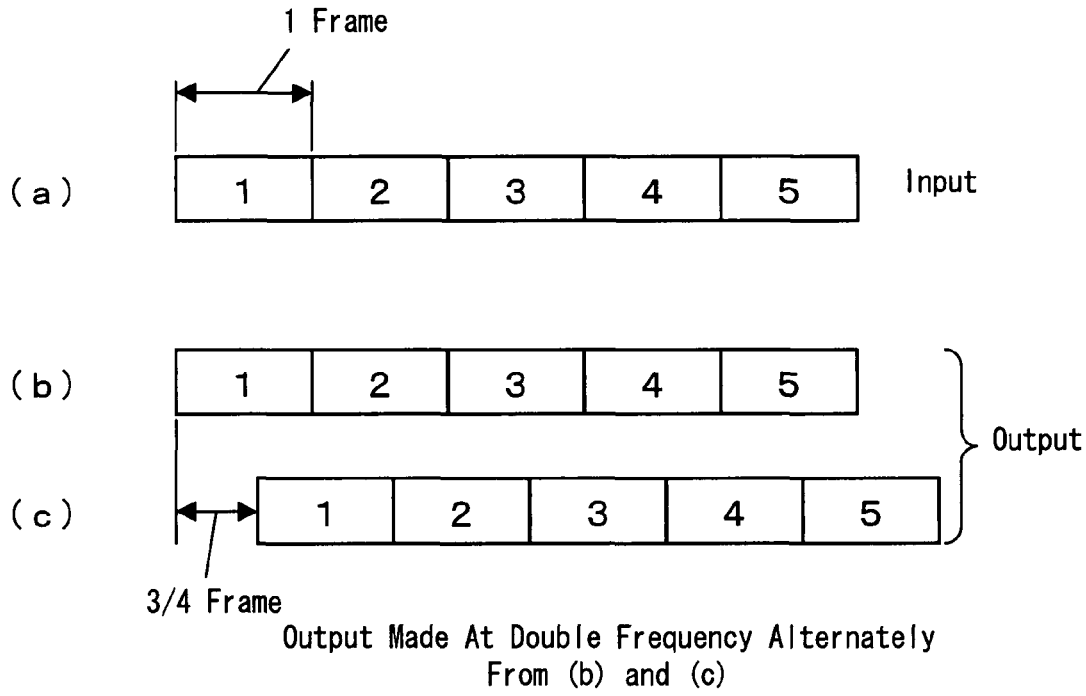
FIG. 4 (*a*) to (*c*) are illustrations of an image signal fed to a frame memory in the display device shown in FIG. 1.
Figure 5:
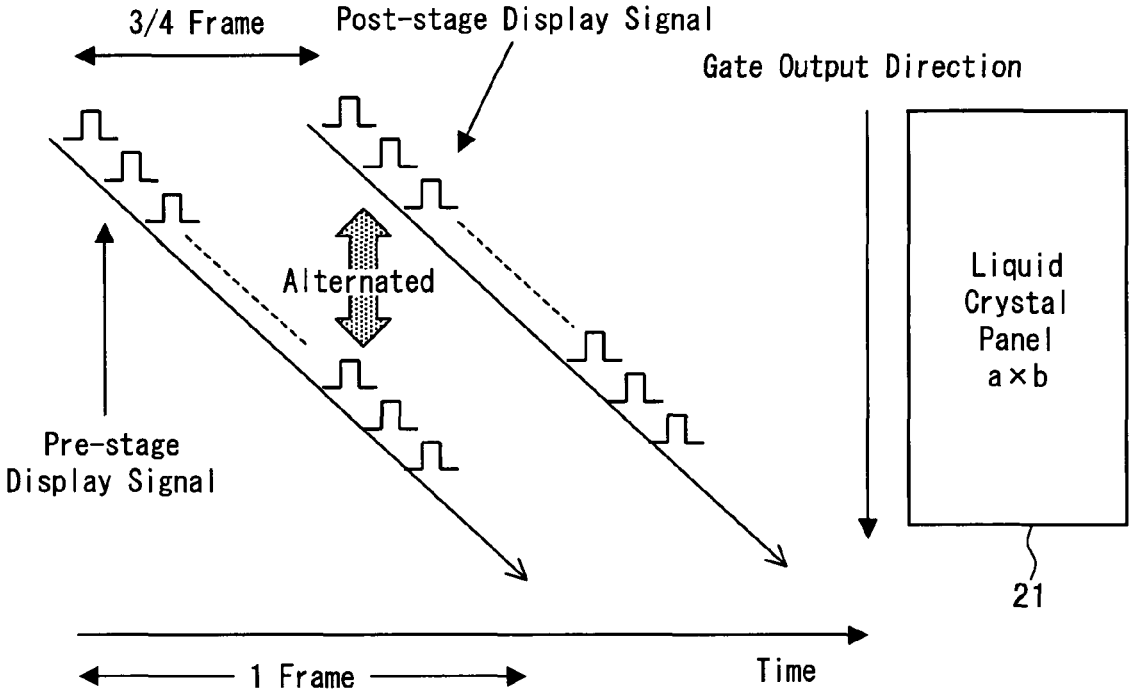
FIG. 5 An illustration of gate line ON timings in relation to a pre-stage display signal and a post-stage display signal for a 3:1 frame division on the display device shown in FIG. 1.

FIG. 4(*a*) is an illustration of an image signal fed to the frame memory 11. FIG. 4(*b*) is an illustration of another image signal supplied from the frame memory 11 to the pre-stage LUT 12 when the division ratio is 3:1. FIG. 4(*c*) is an illustration of another image signal supplied to the post-stage LUT 13 in the same manner. FIG. 5 is an illustration of gate line ON timings in relation to the post-stage display signal and the pre-stage display signal when the division ratio is 3:1 as above.

As depicted in these figures, in this case, the control section 15 writes a pre-stage display signal for the first frame to the pixels on the gate lines in accordance with the ordinary clock. Then, after three quarters of the frame period, the control section 15 starts writing a post-stage display signal. From this moment on, a pre-stage display signal and a post-stage display signal are written alternately in accordance with the double clock.

In other words, after writing a pre-stage display signal to the pixels on the first three quarters of all the gate lines, the post-stage display signal associated with the first gate line is stored in the source driver 23, and that gate line is turned on. Next, the pre-stage display signal associated with the gate line that immediately follows the first three quarters of all the gate lines is stored in the source driver 23, and that gate line is turned on.

This configuration of alternately outputting the pre-stage display signals and the post-stage display signals in accordance with the double clock after three quarters of the first frame enables the division ratio setting for the preceding subframe and the succeeding subframe to 3:1. The total display luminance over these two subframes (integral sum) equals the integral luminance over one frame. The data stored in the frame memory 11 is supplied to the source driver 23 in accordance with gate timings.

Figure 7:
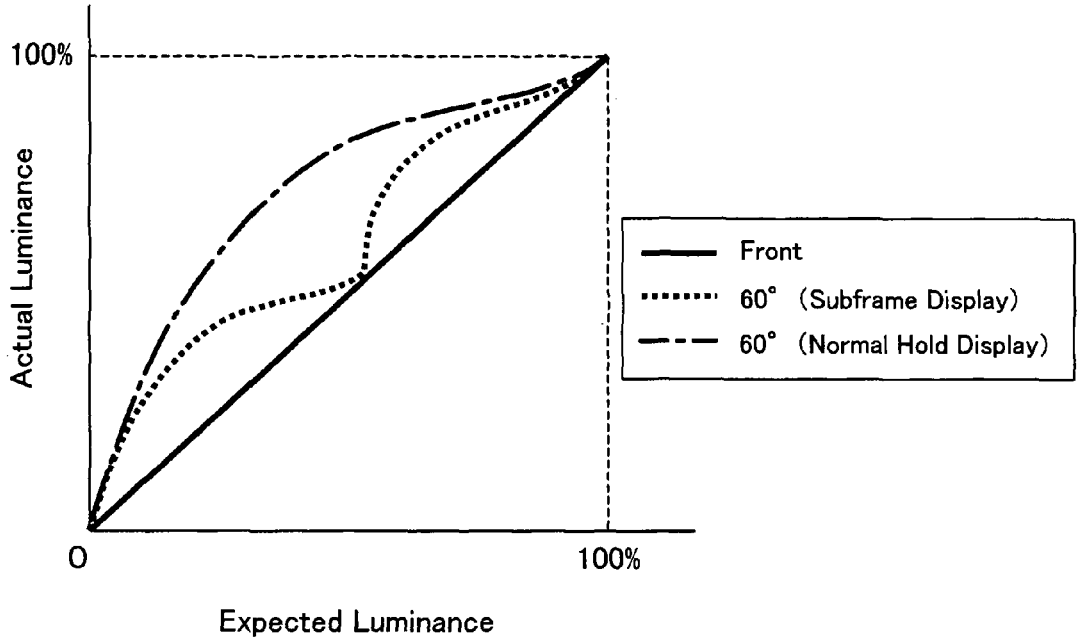
FIG. 7 A graph representing the relationship between expected brightness and actual brightness for a 3:1 frame division on the display device shown in FIG. 1.

FIG. 7 a graph representing a relationship between the expected brightness and the actual brightness when the frame division ratio is 3:1. As shown in FIG. 7, in this configuration, the frame is divided where the discrepancy of the actual brightness from the expected brightness is the largest. Therefore, the difference between the expected brightness and the actual brightness is very small in the case of viewing angle=60° when compared to the results shown in FIG. 6.

In other words, the present display device, in the case of low luminance (low brightness) up to Tmax/4, designates the preceding subframe for black display and uses only the succeeding subframe to produce a display so long as the integral luminance over one frame does not change. Therefore, the discrepancy in the preceding subframe (the difference between the actual brightness and the expected brightness) is reduced to a minimum; the total discrepancy in the two subframes can be reduced to about half as indicated by the broken line in FIG. 7.

In contrast, in a high luminance (high brightness) case, the luminance in only the preceding subframe is adjusted to produce a display, with the succeeding subframe being designated for white display, so long as the integral luminance over one frame does not change. Therefore, the discrepancy in the succeeding subframe in this case is reduced again to a minimum; the total discrepancy in the two subframes can be reduced to about half as indicated by the broken line in FIG. 7.

As explained above, the present display device is capable of reducing overall brightness discrepancy to about half that for structures for ordinary hold display. That more effectively reduces brightness/excess brightness in halftone images (excess brightness phenomenon) shown in FIG. 2.

In the above description, the pre-stage display signal for the first frame written to the pixels on the gate lines in accordance with the ordinary clock in the first three quarters of the frame period since the display is started. This is because a timing is yet to come to write the post-stage display signals.

An alternative approach is to use dummy post-stage display signals so that a display may be produced in accordance with the double clock since the display is started. In other words, a pre-stage display signal and a post-stage display signal with signal grayscale level 0 (dummy post-stage display signal) may be alternately output in the first three quarters of the frame period since the display is started.

Now, the following will describe a more general case where the ratio of the preceding subframe and the succeeding subframe equals n:1. In that case, the control section 15, to achieve a luminance 1/(n+1) times the maximum luminance (threshold luminance; Tmax/(n+1)) in one frame (in a low luminance case), designates the preceding subframe for a minimum luminance (black) and adjusts the display luminance in only the succeeding subframe to produce a grayscale display (only the succeeding subframe is used to produce a grayscale display). The integral luminance over one frame here equals (minimum luminance+luminance in the succeeding subframe)/(n+1).

To achieve a higher luminance than the threshold luminance (Tmax/(n+1)) (in a high luminance case), the control section 15 designates the succeeding subframe for a maximum luminance (white) and adjusts the display luminance in the preceding subframe to produce a grayscale display. The integral luminance over one frame here equals (luminance in the preceding subframe+maximum luminance)/(n+1).

Now, the following will specifically describe such signal grayscale level settings for the display signals (pre-stage display signal and post-stage display signal) that this particular display luminance is achieved. The signal grayscale levels (and output operation which will be detailed later) in this case are also set so as to meet conditions (a), (b).

First, the control section 15 calculates in advance a frame grayscale level corresponding to the threshold luminance (Tmax/(n+1)) by equation 1.

In other words, rearranging equation 1, the frame grayscale level (threshold luminance grayscale level; Lt) which is in accordance with the display luminance is given by:

$$Lt=(1/(n+1))\wedge(1/\gamma)\times L\max \quad (10)$$

When displaying an image, the control section 15 calculates the frame grayscale level L from the image signal output of the frame memory 11. If L≦Lt, the control section 15 controls the pre-stage LUT 12 to set the luminance grayscale level represented by the pre-stage display signal (termed F) to a minimum (0). Meanwhile, the control section 15 controls the post-stage LUT 13 to set the luminance grayscale level represented by the post-stage display signal (termed R) by equation 1 so that $$R=(1/(n+1))\wedge(1/\gamma)\times L \quad (11)$$

If the frame grayscale level L>Lt, the control section 15 sets the luminance grayscale level represented by the post-stage display signal R to a maximum (255). Meanwhile, the control section 15, using equation 1, sets the luminance in the preceding subframe grayscale level F to:

$$F=((L\wedge\gamma-(1/(n+1))\times L\max\wedge\gamma))\wedge(1/\gamma) \quad (12)$$

The display signal output operation for a 3:1 frame division needs only to be designed to start alternately outputting the pre-stage display signals and the post-stage display signals in accordance with the double clock when the first n/(n+1) of the first frame has elapsed.

The equal frame division structure could be described as below. A frame is divided into 1+n subframe periods. Pre-stage display signals are output in one subframe period in accordance with a clock 1+n times an ordinary clock. Post-stage display signals are output continuously in the last n subframe periods.

This structure however needs a very fast clock when n≧2 and adds to device cost. Therefore, the structure explained above in which the pre-stage display signals and the post-stage display signals are alternately output is preferred when n≧2. In this case, the ratio of the preceding subframe and the succeeding subframe can be set to n:1 by adjusting the output timings of the post-stage display signals. Therefore, the necessary clock frequency can be maintained at double the ordinary frequency.

In the present embodiment, the control section 15 converts the image signals to the display signals in the pre-stage LUT 12 and the post-stage LUT 13. The present display device may include more than one pre-stage LUTs 12 and post-stage LUTs 13.

Figure 8:
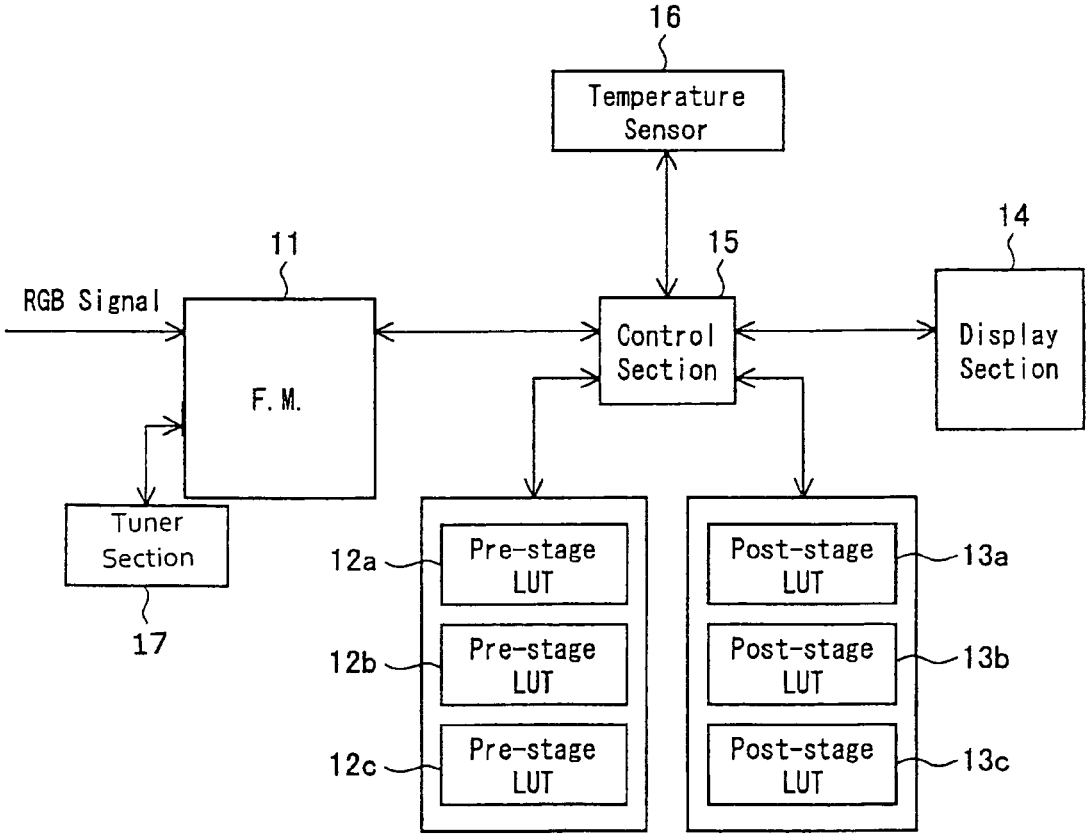
FIG. 8 An illustration of a partially altered version of the structure of the display device shown in FIG. 1.

FIG. 8 shows a modification to the structure shown in FIG. 1 in which the pre-stage LUT 12 is replaced with three pre-stage LUTs 12*a* to 12*c* and the post-stage LUT 13 is replaced with three post-stage LUTs 13*a* to 13*c*. The structure also includes a temperature sensor 16.

The liquid crystal panel 21 changes its response characteristics and grayscale luminance characteristics depending on ambient temperature (temperature of the environment in which the display section 14 sits). That causes the optimal display signals in accordance with the image signals to change with the ambient temperature.

The pre-stage LUTs 12*a* to 12*c* are suitable for use in mutually different temperature ranges. Likewise, the post-stage LUTs 13*a* to 13*c* are suitable for use in mutually different temperature ranges.

The temperature sensor 16 measures the ambient temperature of the present display device and supplies results of the measurement to the control section 15.

In this structure, the control section 15 is designed to switch between the LUTs based on the ambient temperature information supplied by the temperature sensor 16. Therefore, the structure is capable of providing display signals more suitable to the image signals to the liquid crystal panel 21. That enables image display with higher fidelity luminance throughout the anticipated temperature range (for example, from 0° C. to 65° C.).

Furthermore, the liquid crystal panel 21 is preferably AC driven because AC driving enables switching of pixel charge polarity (polarity of the voltage across pixel electrodes sandwiching liquid crystal (electrode-to-electrode voltage)) for each frame.

DC driving applies biased voltage across the electrodes and causes electric charge to accumulate between the electrodes. If the condition continues, potential difference persists between electrodes (generally called an "etching" or "burn-in" phenomenon) even in the absence of voltage application.

In subframe display as carried out on the present display device, the value (absolute value) of the voltage applied across the pixel electrodes often differs from one subframe to the next.

Therefore, if the polarity of the electrode-to-electrode voltage is reversed at the subframe cycle, the applied electrode-to-electrode voltage is biased due to the voltage change between the preceding subframe and the succeeding subframe. If the liquid crystal panel 21 is driven for an extended period of time, electric charge accumulates between the electrodes, possibly causing the etching or flickering mentioned above.

Accordingly, in the present display device, the polarity of the electrode-to-electrode voltage is preferably reversed at a frame cycle (cycle of one frame duration). There are two approaches to the reversing of the polarity of the electrode-to-electrode voltage at a frame cycle. One of them is to apply voltage of the same polarity throughout a frame. The other approach is to reverse the polarity of the electrode-to-electrode voltage between the two subframes in each frame and maintain the polarity between each succeeding subframe and the preceding subframe of the immediately following frame.

Figure 9:
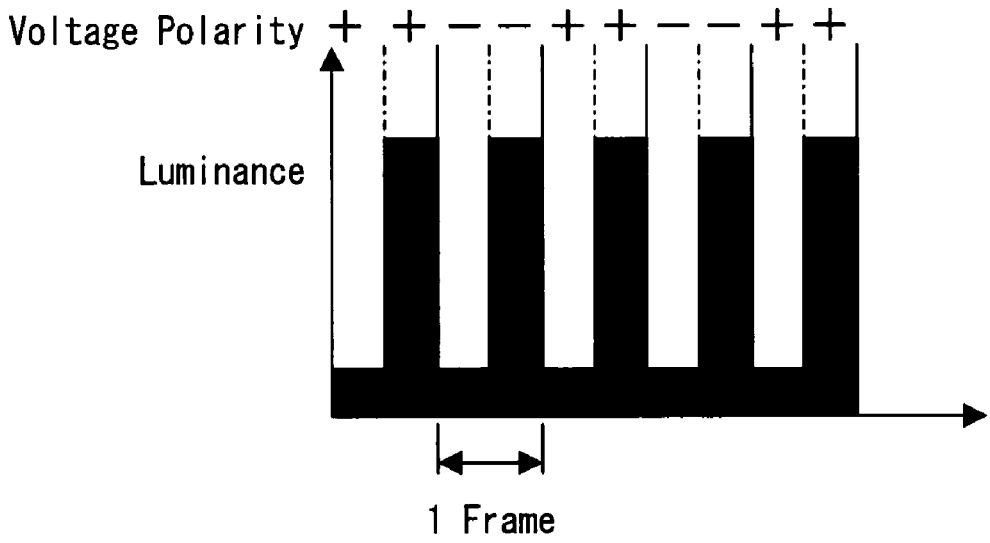
FIG. 9(*a*) An illustration of a method whereby the polarity of an electrode-to-electrode voltage is reversed at a frame cycle.
Figure 9:
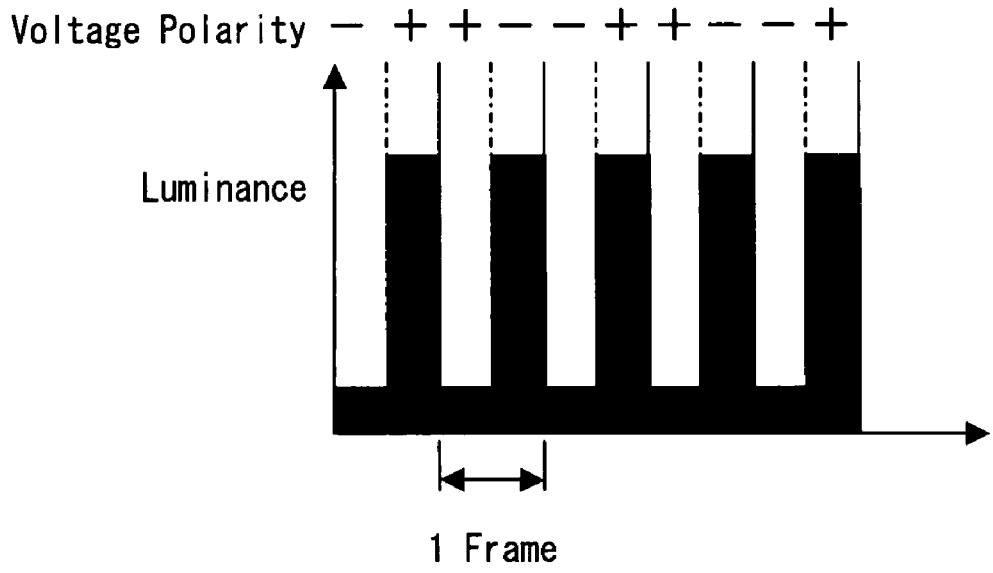

FIG. 9(*a*) depicts a relationship between the voltage polarity (polarity of the electrode-to-electrode voltage) and the frame cycle for the former approach. FIG. 9(*b*) depicts a relationship between the voltage polarity and the frame cycle for the latter approach. Alternating the electrode-to-electrode voltage at the frame cycle in this manner prevents etching and flickering even when the electrode-to-electrode voltage differs greatly from one subframe to the next.

As described earlier, the present display device drives the liquid crystal panel 21 according to a subframe display scheme. That is how the device mitigates excess brightness. However, this advantage of subframe display can be somewhat lost if the liquid crystal has a slow response rate (rate at which the voltage across the liquid crystal (electrode-to-electrode voltage) becomes equal to the applied voltage).

In other words, for ordinary hold display on a TFT liquid crystal panel, one liquid crystal state corresponds to a luminance grayscale level. Therefore, the response characteristics of the liquid crystal does not depend on the luminance grayscale level represented by the display signal.

Figure 10:
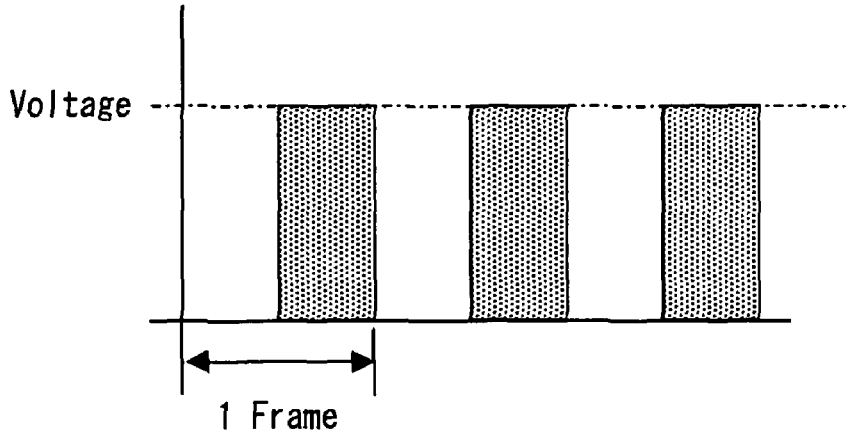
FIG. 10(*a*) An illustration depicting the response rate of liquid crystal.
Figure 10:
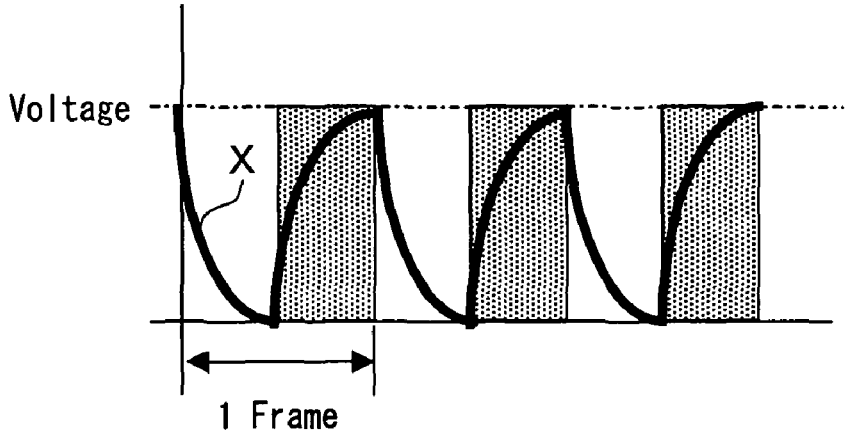
Figure 10:
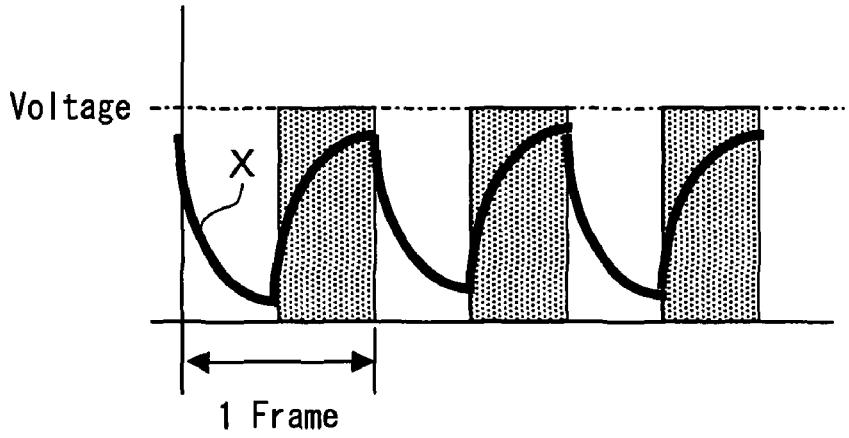

On the other hand, in subframe display as carried out on the present display device, to produce a display from a display signal representing a halftone grayscale level, in which the preceding subframe is designated for a minimum luminance (white) and the succeeding subframe is designated for a maximum luminance, the voltage applied across the liquid crystal over one frame alters as shown in FIG. 10(*a*). The electrode-to-electrode voltage changes as indicated by solid line X in FIG. 10(*b*) in accordance with the response rate (response characteristics) of the liquid crystal.

If that halftone display is produced when the liquid crystal has a slow response rate, the electrode-to-electrode voltage (solid line X) changes as shown in FIG. 10(*c*). Therefore, in this case, the display luminance in the preceding subframe is not a minimum and the display luminance in the succeeding subframe is not a maximum.

Figure 11:
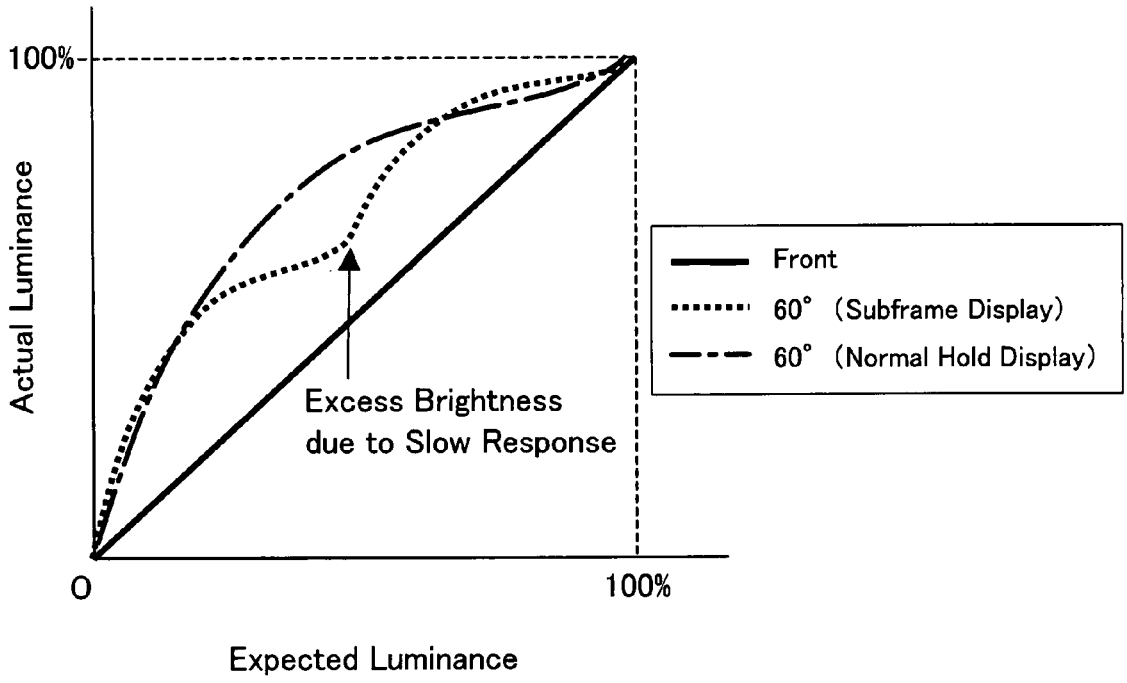
FIG. 11 A graph representing display luminance outputs of a liquid crystal panel (relationship between expected luminance and actual luminance) for subframe display using a slow-response liquid crystal.

Hence, the relationship between the expected luminance and the actual luminance can be represented as shown in FIG. 11. The graph indicates that the subframe display fails at large viewing angles to produce a display with such luminance (minimum luminance and maximum luminance) that the difference (discrepancy) between the expected luminance and the actual luminance is small. The excess brightness phenomenon is thus less mitigated.

Therefore, to perform good subframe display as carried out by the present display device, the response rate of the liquid crystal in the liquid crystal panel 21 is preferably designed to meet conditions (c) and (d):

(c) If a voltage signal for a maximum luminance (white; equivalent to a maximum brightness), generated by the source driver 23 from a display signal, is applied to liquid crystal outputting a minimum luminance (black; equivalent to a minimum brightness), the voltage across the liquid crystal (electrode-to-electrode voltage) reaches 90% or more of the voltage represented by the voltage signal in the shorter one of two subframe periods (the actual brightness as viewed from the front reaches 90% of the maximum brightness); and (d) If a voltage signal for a minimum luminance (black) is applied to liquid crystal outputting a maximum luminance (white), the voltage across the liquid crystal (electrode-to-electrode voltage) reaches 5% or less of the voltage represented by the voltage signal in the shorter one of two subframe periods (the actual brightness as viewed from the front reaches 5% of the minimum brightness).

The control section 15 is preferably designed to monitor the response rate of the liquid crystal. The control section 15 may be set up to discontinue the subframe display to drive the liquid crystal panel 21 by ordinary hold display if changes in ambient temperature or other factors slow down the response rate of the liquid crystal so much that the control section 15 has determined that it is no longer capable of meeting conditions (c), (d).

The setup enables switching of the display scheme of the liquid crystal panel 21 to ordinary hold display when the subframe display has intensified, rather than mitigated, an excess brightness phenomenon.

In the present embodiment, the present display device functions as a liquid crystal monitor. The present display device, however, may function as a liquid crystal television receiver (liquid crystal television). The liquid crystal television is realized by adding a tuner section 17 to the present display device. The tuner section 17 selects a channel from television broadcast signals and transmits the television image signals on the selected channel to the control section 15 via the frame memory 11. In this structure, the control section 15 generates the display signals from the television image signals.

In the present embodiment, in low luminance cases, the preceding subframe is designated for black, and only the succeeding subframe is used to produce a grayscale display. The same display is achieved even when the settings for the two subframes are transposed (in low luminance cases, the succeeding subframe is designated for black, and only the preceding subframe to produce a grayscale display).

In the present embodiment, the luminance grayscale levels of the display signals (pre-stage display signal and post-stage display signal) (signal grayscale levels) are set using equation 1. However, the actual panel has luminance even in black display cases (grayscale level=0), and moreover, the response rate of the liquid crystal is finite. Therefore, these factors are preferably taken into account in the setting of signal grayscale levels. More specifically, it is preferable to actually produce an image on the liquid crystal panel 21, actually measure relationship between the signal grayscale levels and the display luminance, and determine an LUT (output table) that fits equation 1 from results of the actual measurement.

In the present embodiment, $\alpha$ in equation (6a) is set in the range of 2.2 to 3. The range, although not technically proven, can be considered suitable in relation to human vision.

If a source driver for ordinary hold display is used as the source driver 23 in the present display device, voltage signals are supplied to pixels (liquid crystal) in accordance with the incoming signal grayscale levels (luminance grayscale level represented by a display signal) so that the display luminance obtained by setting $\gamma$ to 2.2 in equation 1 can be obtained.

That source driver 23 outputs voltage signals as they are used in ordinary hold display in accordance with the incoming signal grayscale levels in each subframe even when subframe display is carried out.

This voltage signal output method may fail to equate the total luminance in one frame in subframe display to a value in the case of ordinary hold display (may fail to reproduce from the signal grayscale levels).

Therefore, in subframe display, the source driver 23 is preferably designed to output voltage signals converted for divided luminance. In other words, the source driver 23 is preferably set up to fine tune the voltage applied to the liquid crystal (electrode-to-electrode voltage) in accordance with the signal grayscale levels. To this end, it is preferable to design the source driver 23 for subframe display to enable the fine tuning.

In the present embodiment, the liquid crystal panel 21 is a VA panel. This is however not the only possibility. The excess brightness phenomenon can be mitigated by subframe display on the present display device even by using a liquid crystal panel of mode other than VA mode.

In other words, the subframe display implemented by the present display device is capable of mitigating the excess brightness phenomenon on liquid crystal panels with which there occurs a discrepancy between the expected luminance (expected brightness) and the actual luminance (actual brightness) at large viewing angles (liquid crystal panels of a mode in which grayscale gamma characteristics may change in relation to viewing angle change).

The subframe display implemented by the present display device is particularly effective with liquid crystal panels having such characteristics that the display luminance intensifies with increasing viewing angle.

The liquid crystal panel 21 in the present display device may be NB (Normally Black; normally black) or NW (Normally White; normally white).

Furthermore, in the present display device, the liquid crystal panel 21 may be replaced with another display panel (for example, an organic EL panel or a plasma display device panel).

The frame is preferably divided into 1:3 to 1:7 in the present embodiment. This is however not the only possibility.

The present display device may be designed to divide the frame into 1:n or n:1 (n is a natural number greater than or equal to 1).

The present embodiment uses equation (10) to make signal grayscale level settings for the display signals (pre-stage display signal and post-stage display signal). The settings are made assuming that the response rate of the liquid crystal is 0 ms and that T0 (minimum luminance)=0. Therefore, in actual use, more elaborate settings are preferred.

Specifically, the maximum luminance (threshold luminance) that can be reached in one of the two subframes (succeeding subframe) equals Tmax/(n+1) when the liquid crystal response is 0 ms and T0=0. The threshold luminance grayscale level Lt is the frame grayscale level of that luminance.

$$Lt=(((T\max/(n+1))/T\max)\wedge(1/\gamma))\times L\max(\gamma=2.2)$$

If the response rate of the liquid crystal is not 0, for example, black→white is a Y % response in a subframe, white→black is a Z % response in a subframe, and T0=T0, the threshold luminance (Lt luminance) Tt is given by $$Tt=((T\max-T0)\times Y/100+(T\max-T0)\times Z/100)/2$$

Therefore, $$Lt=(((Tt-T0)/(T\max-T0))\wedge(1/\gamma))\times L\max(\gamma=2.2)$$

Actually, Lt can in some cases be a little more complex with the threshold luminance Tt being unable to be given by a simple equation, making it difficult to give Lt in terms of Lmax. To obtain Lt in such cases, it is preferred to use results of measurement of the luminance of the liquid crystal panel. In other words, the luminance of the liquid crystal panel in a case where one of the two subframes outputs a maximum luminance, and the other subframe outputs a minimum luminance is measured, and the luminance is denoted by Tt. A spilled grayscale level Lt is determined from the following equation.

$$Lt=(((Tt-T0)/(T\max-T0))\wedge(1/\gamma))\times L\max(\gamma=2.2)$$

In this manner, it can be said that Lt obtained by using equation (10) has an ideal value and is in some cases preferably used as a rough reference.

Figure 12:
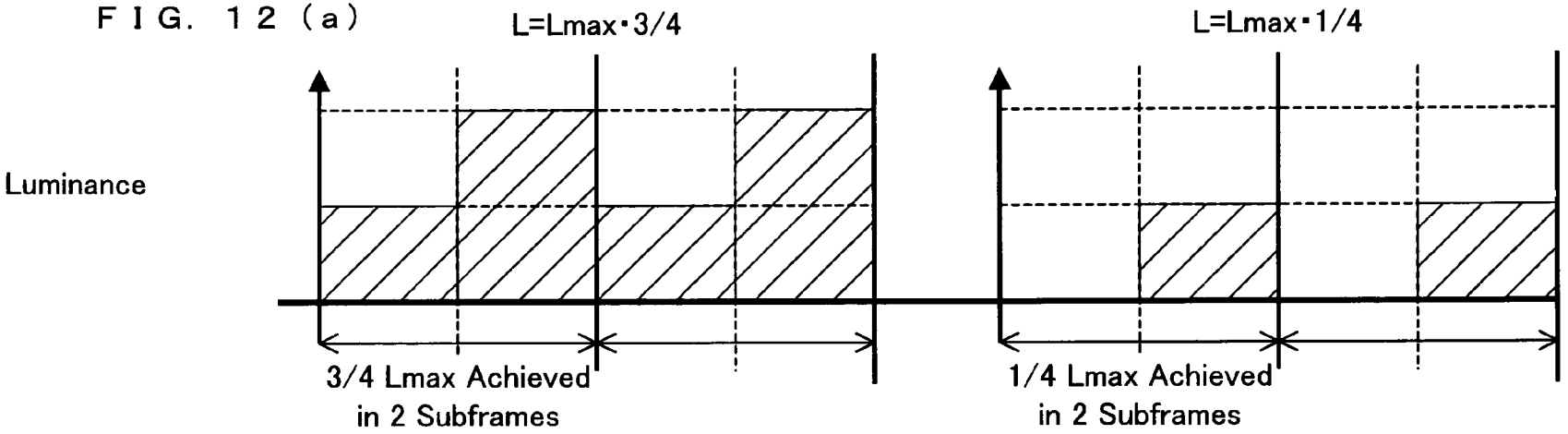
FIG. 12(*a*) A graph representing the luminance in a preceding subframe and a succeeding subframe for a display luminance three quarters of Lmax and a display luminance a quarter of Lmax.
Figure 12:
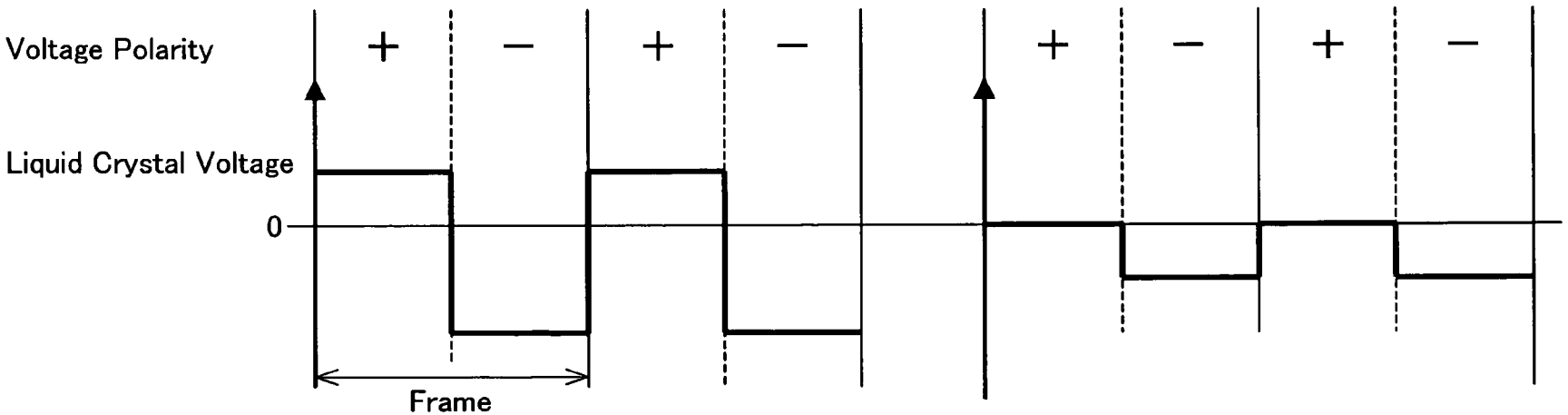

Now, the fact that in the present display device, the polarity of the electrode-to-electrode voltage is preferably reversed at the frame cycle will be described in more detail. FIG. 12(*a*) is a graph representing the luminance in the preceding subframe and the succeeding subframe for a display luminance three quarters of Lmax and a display luminance a quarter of Lmax. As shown in the figure, when subframe display is carried out as on the present display device, the value of the voltage applied to the liquid crystal (value of the voltage applied across the pixel electrodes; absolute value) differs from one subframe to the next.

Therefore, if the polarity of the voltage applied to the liquid crystal (liquid crystal driving voltage) is reversed at the subframe cycle, as shown in FIG. 12(*b*), there occurs an irregular applied liquid crystal driving voltage (the total applied voltage does not equal 0 V) due to difference in voltage value between the preceding subframe and the succeeding subframe. Therefore, the DC component of the liquid crystal driving voltage cannot be eliminated. Thus, if the liquid crystal panel 21 is driven for an extended period of time, electric charge accumulates between the electrodes, thereby possibly causing etching, burn-in, or flickering.

Accordingly, in the present display device, the polarity of the liquid crystal driving voltage is preferably reversed at the frame cycle. There are two approaches to the reversing of the polarity of the liquid crystal driving voltage at the frame cycle. One of them is to apply voltage of the same polarity throughout a frame. The other approach is to reverse the polarity of the liquid crystal driving voltage between the two subframes in each frame and maintain the polarity between each succeeding subframe and the preceding subframe of the immediately following frame.

Figure 13:
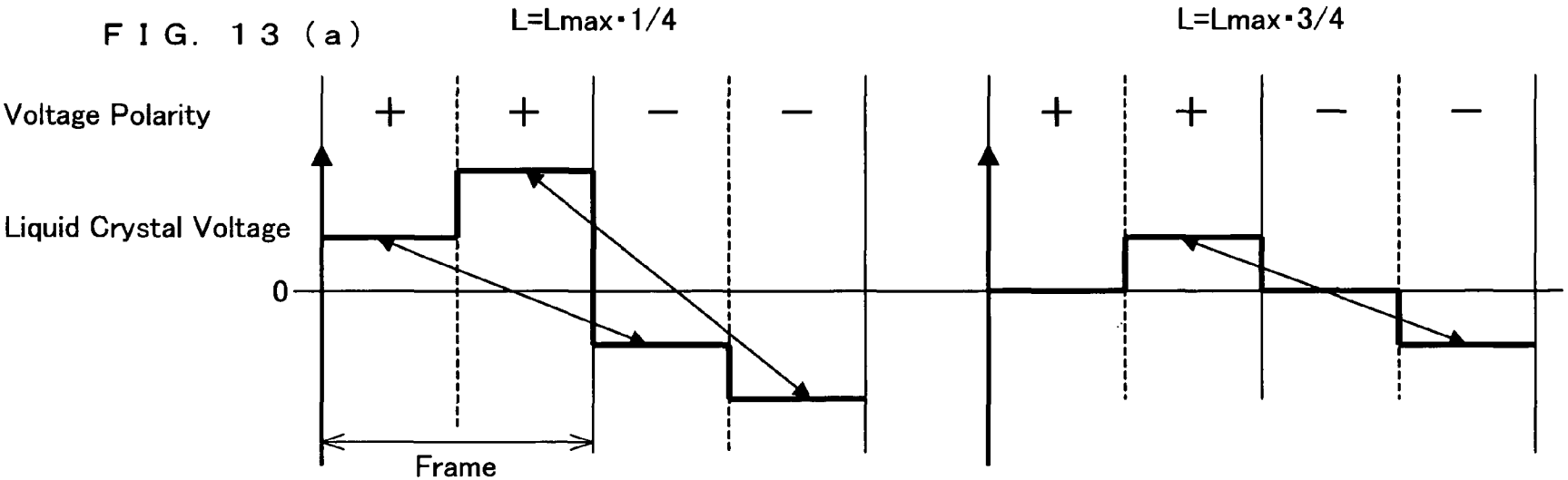
FIG. 13(*a*) An illustration of a method whereby the polarity of an electrode-to-electrode voltage is reversed at a frame cycle.
Figure 13:
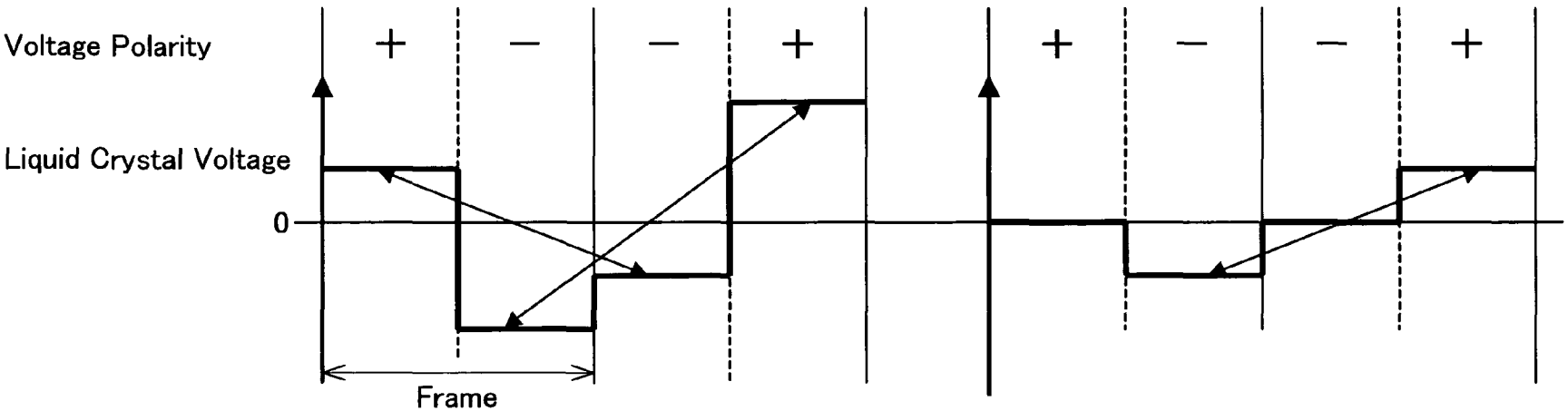

FIG. 13(*a*) is a graph representing a relationship between the voltage polarity (liquid crystal driving voltage polarity), the frame cycle, and the liquid crystal driving voltage for the former approach. In contrast, FIG. 13(*b*) is a graph representing the same relationship for the latter approach.

As depicted in these graphs, if the liquid crystal driving voltage is reversed at one frame cycle, the average voltage of the preceding subframes of two adjacent frames and the average voltage of the succeeding subframes of the two adjacent frames can be rendered 0 V. Therefore, the average voltage over the two frames can be rendered 0 V, making it possible to eliminate the DC component of the applied voltage. Alternating the liquid crystal driving voltage at the frame cycle in this manner prevents etching, burn-in, and flickering even when the liquid crystal driving voltage differs greatly from one subframe to the next.

Figure 14:
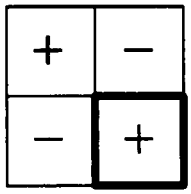
FIG. 14(*a*) An illustration showing four pixels in a liquid crystal panel and the polarities of liquid crystal driving voltages for the pixels.
Figure 14:
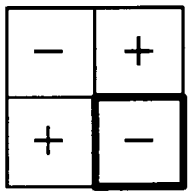
Figure 14:
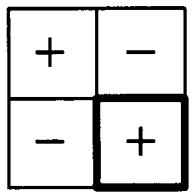
Figure 14:
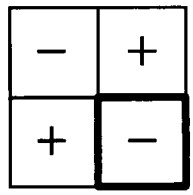

FIGS. 14(*a*) to 14(*d*) are illustrations showing four pixels in the liquid crystal panel 21 and the polarities of liquid crystal driving voltages for pixels. As mentioned earlier, the polarity of the voltage applied to each pixel is preferably reversed at the frame cycle. In a case like this, the polarities of the liquid crystal driving voltages for the pixels are changed at a frame cycle as shown in the order of FIGS. 14(*a*) to 14(*d*).

The sum of the liquid crystal driving voltages applied to all the pixels in the liquid crystal panel 21 is preferably 0 V. This control can be realized by, for example, changing voltage polarity between adjoining pixels as shown in FIGS. 14(*a*) to 14(*d*).

In the present embodiment, the ratio of the preceding subframe period and the succeeding subframe period (frame division ratio) is preferably set in a range from 3:1 to 7:1. This is however not the only possibility. The frame division ratio may be set in a range from 1:1 or 2:1.

For example, if the frame division ratio is set to 1:1, as shown in FIG. 3, the actual luminance can be brought closer to the expected luminance than in ordinary hold display. In addition, as shown in FIG. 6, the same is true with brightness; the actual brightness can be brought closer to the expected brightness than in ordinary hold display. Therefore, in a case like this, it is clear that viewing angle characteristics can again improve over ordinary hold display.

The liquid crystal panel 21 needs a time in accordance with the response rate of the liquid crystal to render the liquid crystal driving voltage (voltage applied to the liquid crystal; electrode-to-electrode voltage) have a value in accordance with the display signal. Therefore, if one of the subframe periods is too short, the voltage across the liquid crystal can possibly not raised to a value that is in accordance with the display signal within this period.

Setting the ratio between the preceding subframe and the succeeding subframe period to 1:1 or 2:1 prevents one of the two subframe periods from becoming too short. Therefore, suitable display can be carried out even when using a slow-response liquid crystal.

The frame division ratio (ratio of the preceding subframe and the succeeding subframe) may be set to n:1 (n is a natural number greater than or equal to 7). Alternatively, the frame division ratio may be set to n:1 (n is a real number greater than or equal to 1, preferably a real number greater than 1). Setting the frame division ratio to, for example, 1.5:1 improves the viewing angle characteristics over the 1:1 setting and makes it easier to use the slow-response liquid crystal material than the 2:1 setting.

Even in cases where the frame division ratio is set to n:1 (n is a real number greater than or equal to 1), to display an image with low luminance (low brightness), no brighter than 1/(n+1) times the maximum luminance (=Tmax/(n+1)), preferably, only the succeeding subframe is used to produce the display, with the preceding subframe being designated for black display. In addition, to display an image with high luminance (high brightness), Tmax(n+1) or brighter, preferably, the luminance in only the preceding subframe is adjusted to produce a display, with the succeeding subframe being designated for white display. Accordingly, one subframe is always in such a state that there is no difference between the actual luminance and the expected luminance. Therefore, the present display device has good viewing angle characteristics.

If the frame division ratio is n:1, substantially the same effects are expected no matter which one of the preceding and succeeding frames is set to n. In other words, n:1 and 1:n are identical with respect to viewing angle improving effects. In addition, n, when it is a real number greater than or equal to 1, is effective in the control of the luminance grayscale levels using equations (10) to (12) shown above.

In the present embodiment, the subframe display implemented by the present display device is a display produced by dividing the frame into two subframes. This is however not the only possibility. The present display device may be designed to carry out subframe display in which the frame is divided into three or more subframes.

In the subframe display in which a frame divided into m pieces, in a very low luminance case, the m−1 subframes are designated for black display, whilst the luminance (luminance grayscale level) of only one subframe is adjusted to produce a display. This subframe is designated for white display when the luminance becomes so high that this subframe alone cannot deliver the required luminance. The m−2 subframes are then designated for black display, whilst the luminance in the remaining one subframe is adjusted to produce a display.

In other words, even when the frame is divided into m pieces, preferably, there is always one and only one subframe of which the luminance is adjusted (changed) similarly to the case where the frame is divided into two pieces, whilst the other subframes are designated for either white display or black display. Accordingly, the m−1 subframes can be designated for a state in which there is no discrepancy between the actual luminance and the expected luminance. Therefore, the present display device has good viewing angle characteristics.

Figure 15:
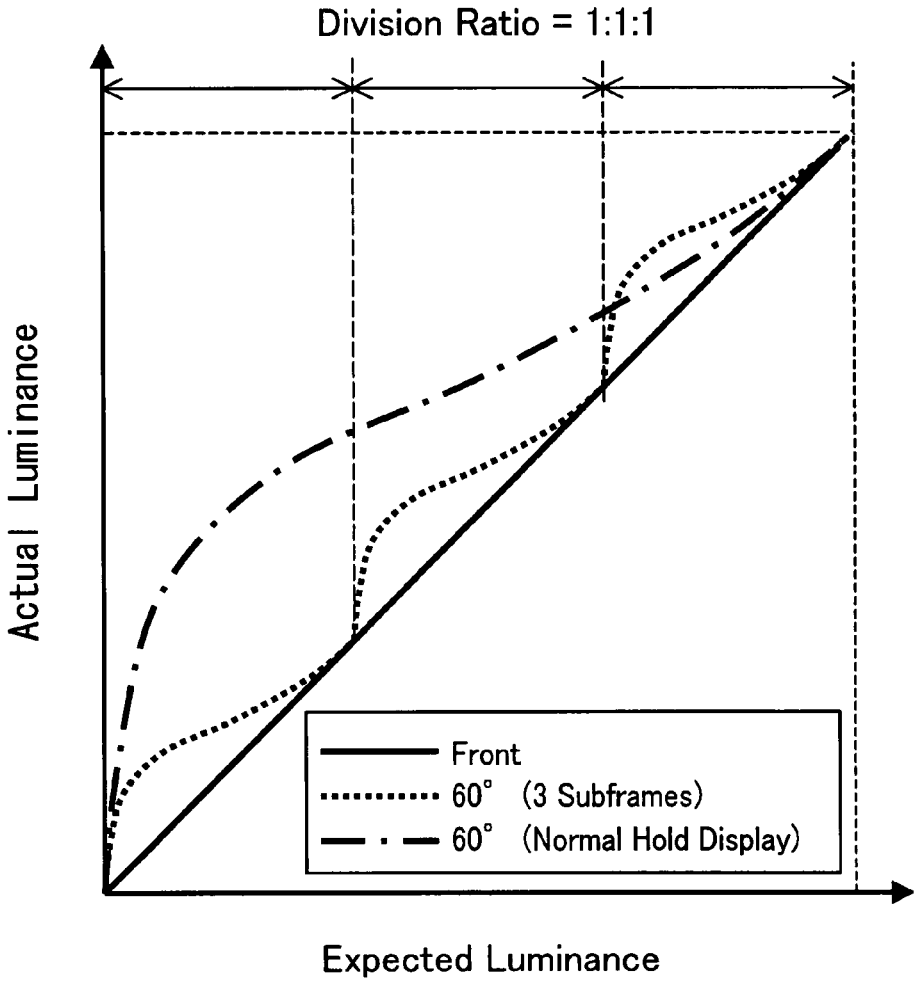
FIG. 15 A graph representing results of displays produced by dividing a frame equally into three subframes (broken line and solid line) and results of ordinary hold display (dash-dot line and solid line).

FIG. 15 is a graph representing results of displays produced on the present display device by dividing the frame equally into three subframes (broken line and solid line) as well as results of ordinary hold display (dash-dot line and solid line; similar to the results shown in FIG. 2. As can be seen from the graph, increasing the number of subframes to three moves the actual luminance closer to the expected luminance. Therefore, the present display device has further improved viewing angle characteristics.

Figure 16:
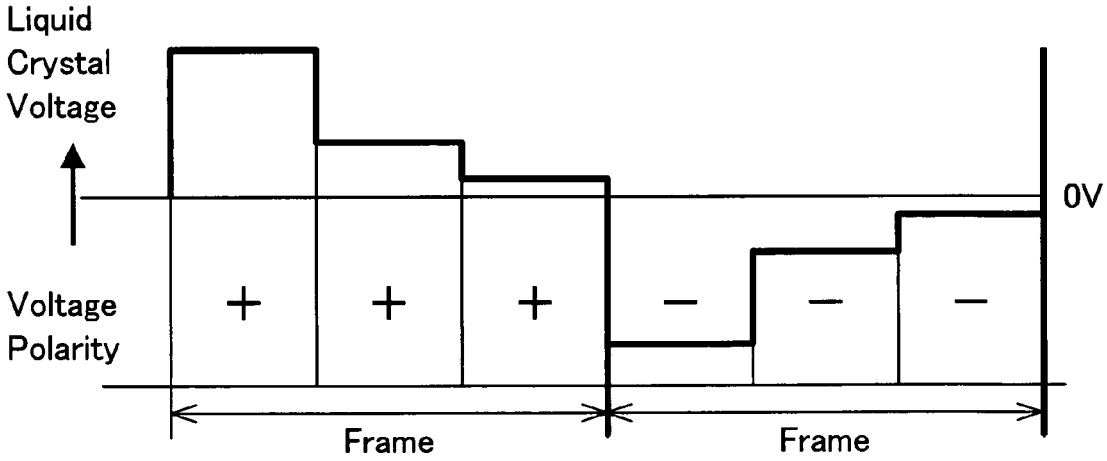
FIG. 16 A graph representing transitioning of a liquid crystal driving voltage in a case where each frame is divided into three subframes and the voltage polarity is reversed from one frame to the next.

Even when the frame is divided into m pieces, the aforementioned polarity reversion driving is preferably carried out. FIG. 16 is a graph representing transitioning of a liquid crystal driving voltage when the frame is divided into three subframes and the voltage polarity is reversed for each frame. As shown in the figure, in a case like this, the average liquid crystal driving voltage over the two frames can again be rendered 0 V.

Figure 17:
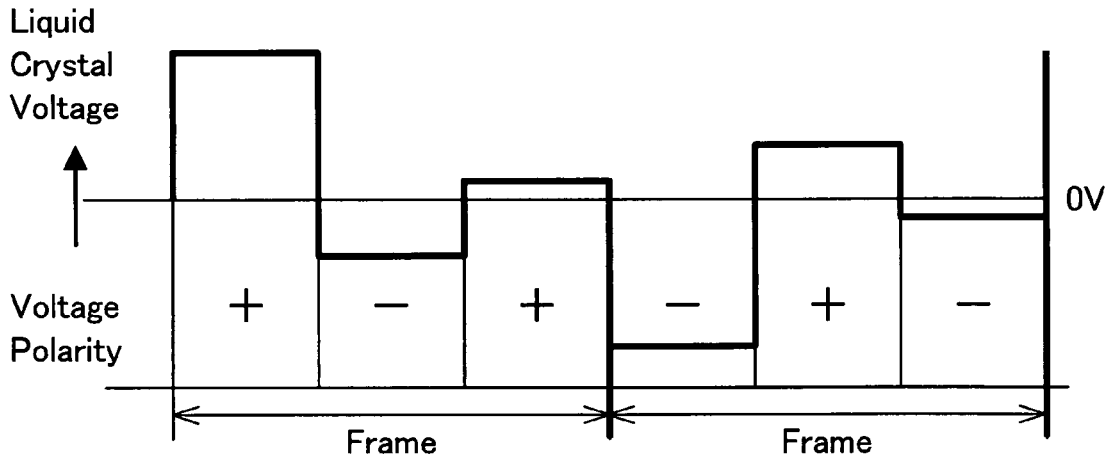
FIG. 17 A graph representing transitioning of a liquid crystal driving voltage in a case where each frame is divided into three subframes and the voltage polarity is reversed from one subframe to the next.

FIG. 17 is a graph representing transitioning of a liquid crystal driving voltage when the frame is similarly divided into three subframes and the voltage polarity is reversed for each subframe. When the frame is divided into an odd number of pieces in this manner, even if the voltage polarity is reversed for each subframe, the average liquid crystal driving voltage over the two frames can be rendered 0 V. Therefore, when the frame is divided into m pieces (m is an integer greater than or equal to 2), liquid crystal driving voltage of different polarity is preferably applied in the m-th (M; 1 to m) subframes of adjoining frames under the control of the control section 15. Accordingly, the average liquid crystal driving voltage over the two frames can be rendered 0 V.

When the frame is divided into m pieces (m is an integer greater than or equal to 2), the polarity of the liquid crystal driving voltage is preferably reversed so that the total liquid crystal driving voltage over two (or more) frames becomes 0 V.

In the foregoing, when the frame is divided into m pieces, preferably, there is always one and only one subframe of which the luminance is adjusted, whilst the other subframes are designated for either white display (maximum luminance) or black display (minimum luminance).

This is however not the only possibility. There may be two or more subframes in which the luminance is adjusted. In a case like this, viewing angle characteristics are again improved by designating at least one subframe for white display (maximum luminance) or black display (minimum luminance).

The luminance in the subframes in which luminance is not adjusted may be set to, instead of a maximum luminance, a maximum or a value greater than a second predetermined value. That luminance may be set to, instead of a minimum luminance, a minimum or a value less than a first predetermined value. In a case like this, the discrepancy between the actual brightness and the expected brightness (brightness discrepancy) in the subframes in which luminance is not adjusted can again be reduced sufficiently. Therefore, the present display device has improved viewing angle characteristics.

Figure 18:
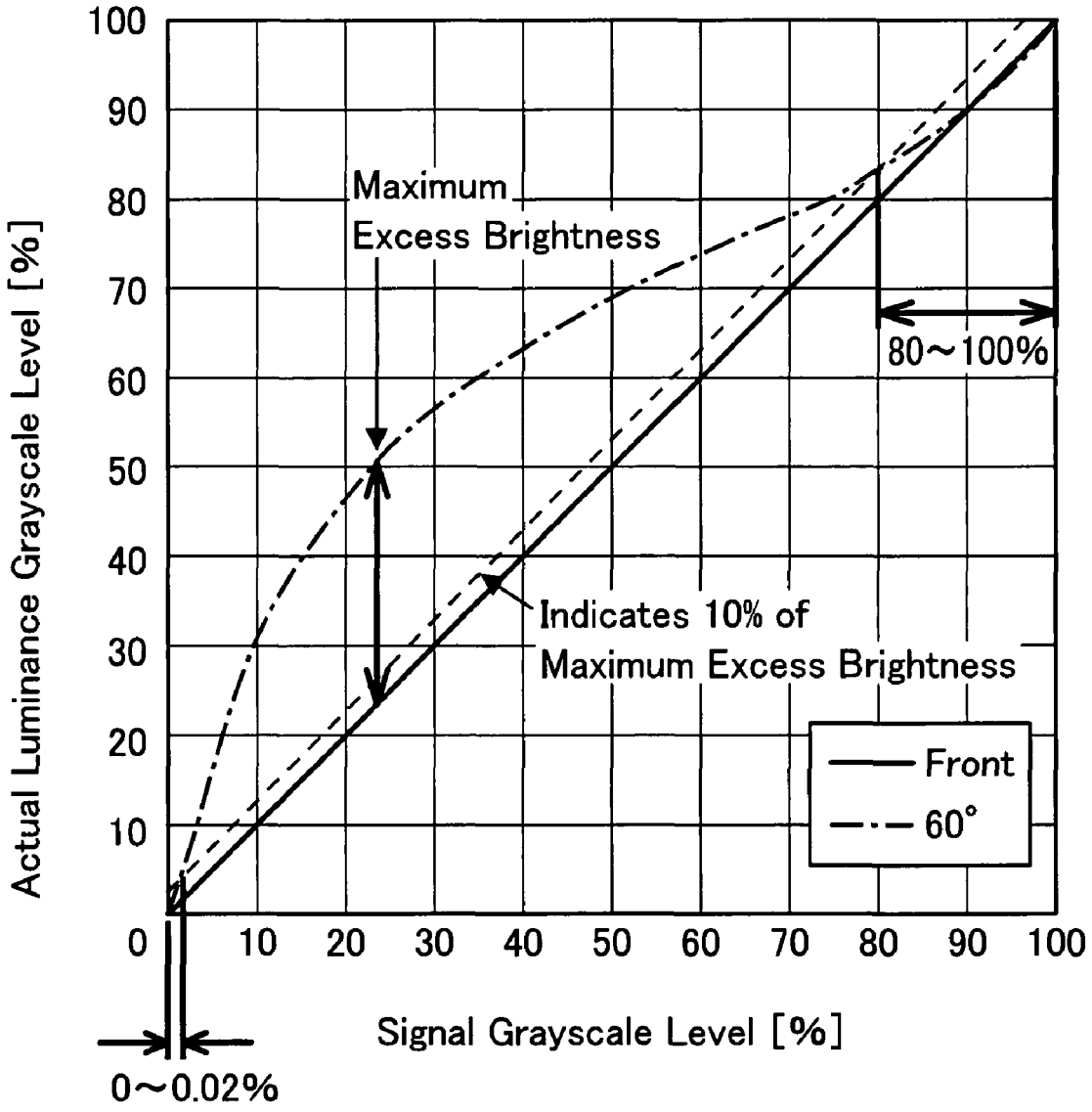
FIG. 18 A graph representing, for a subframe in which luminance is not adjusted, relationship (viewing angle grayscale characteristics (actual measurements)) between the signal grayscale level (%; luminance grayscale level represented by a display signal) output supplied to a display section and the actual luminance grayscale level (%) in accordance with that signal grayscale level.

FIG. 18 is a graph representing a relationship (viewing angle grayscale characteristics (actual measurements)) in the subframes in which luminance is not adjusted between a signal grayscale level output (%; luminance grayscale level represented by a display signal) on the display section 14 and the actual luminance grayscale level (%) in accordance with that signal grayscale level.

The "actual luminance grayscale level" refers to a result of conversion into a luminance grayscale level using equation 1 of a luminance output (actual luminance) on the liquid crystal panel 21 in the display section 14 in accordance with a signal grayscale level.

As can be seen from the graph, the aforementioned two grayscale levels are equal when the liquid crystal panel 21 is viewed from the front (that is, viewing angle=0°). In contrast, when the viewing angle is 60°, the actual luminance grayscale level appears brighter than signal grayscale level at halftone due to excess brightness. The excess brightness is a maximum when the luminance grayscale level is 20% to 30%, irrespective of viewing angle.

It is known that so long as the excess brightness does not exceed 10% of the maximum value indicated by the broken line in the graph, the present display device is capable of sustaining sufficiently display quality (keeping the aforementioned brightness discrepancy sufficiently small). The excess brightness stays within 10% of the maximum value when the signal grayscale level is in the ranges of 80 to 100% and 0 to 0.02% of its maximum value. These ranges are invariable with respect to the viewing angle.

Therefore, the second predetermined value is preferably set to 80% of the maximum luminance. The first predetermined value is preferably set to 0.02% of the maximum luminance.

In addition, there is no need to provide subframes in which luminance is not adjusted. In other words, when a display is to be produced using m subframes, there is no need to create different display states for the subframes. This configuration is still capable of the polarity reversion driving explained above whereby the polarity of the liquid crystal driving voltage is reversed at the frame cycle. When a display is to be produced using m subframes, creating a slight difference between the display states of the subframes can improve the viewing angle characteristics of the liquid crystal panel 21.

In the present embodiment, subframe display is used to improve the viewing angle characteristics of liquid crystal (mitigate excess brightness). This is however not the only possibility. The same subframe display is capable of also improving the display quality of moving images.

More specifically, if one follows the motion of an object being displayed by ordinary hold display with his/her eyes, he/she would perceive at the same time the color and brightness of the immediately preceding frame. That results in the viewer perceiving blurred object edges. In contrast, when producing a moving image by subframe display (especially, at low luminance), the luminance in one of the subframes in each frame is low. The low luminance subframe restrains visual mixing of the currently perceiving frame image and the immediately preceding frame image (color, brightness). The edge blurring is thereby prevented, improving the display quality of moving images.

As mentioned earlier, the signal grayscale levels and the display luminance of a liquid crystal panel are related approximately by equation 1.

$$((T-T0)/(T\max-T0))=(L/L\max)^{\gamma} \quad (1)$$

where L is a signal grayscale level in ordinary hold display in which an image is displayed over a frame (frame grayscale level), Lmax is a maximum luminance grayscale level (=255 when the grayscale level signal is an 8-bit signal), T is a display luminance, Tmax is a maximum luminance (luminance when L=Lmax=255; white) T0 is a minimum luminance (luminance when L=0; black), and γ is a correction value (typically, 2.2). In addition, L/Lmax is a value generally called a normalized display grayscale level. (L/Lmax)^γ is a value generally called a normalized luminance.

Figure 19:
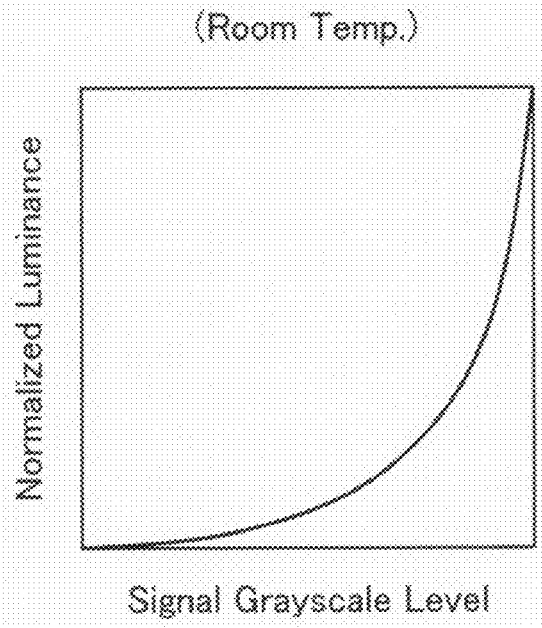
FIG. 19 A grayscale level-luminance curve plotted on a graph of normalized luminance and signal grayscale level for a liquid crystal panel.

FIG. 19 is a grayscale level-luminance curve (γ-curve) plotted on a graph of normalized luminance and signal grayscale level at room temperature (25° C.). The figure shows a preferred, smooth grayscale level-luminance curve for the present display device (which agrees with the γ-curve).

Figure 20:
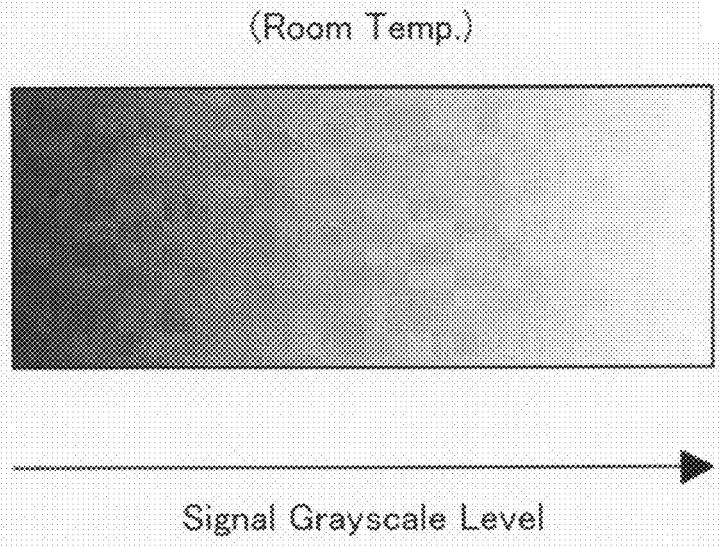
FIG. 20 An illustration of grayscale display produced by a liquid crystal panel.

If that is the case, the liquid crystal panel produces grayscale on the display screen in the form of natural gradation in accordance with changes in the signal grayscale level as shown in FIG. 20.

Figure 23:
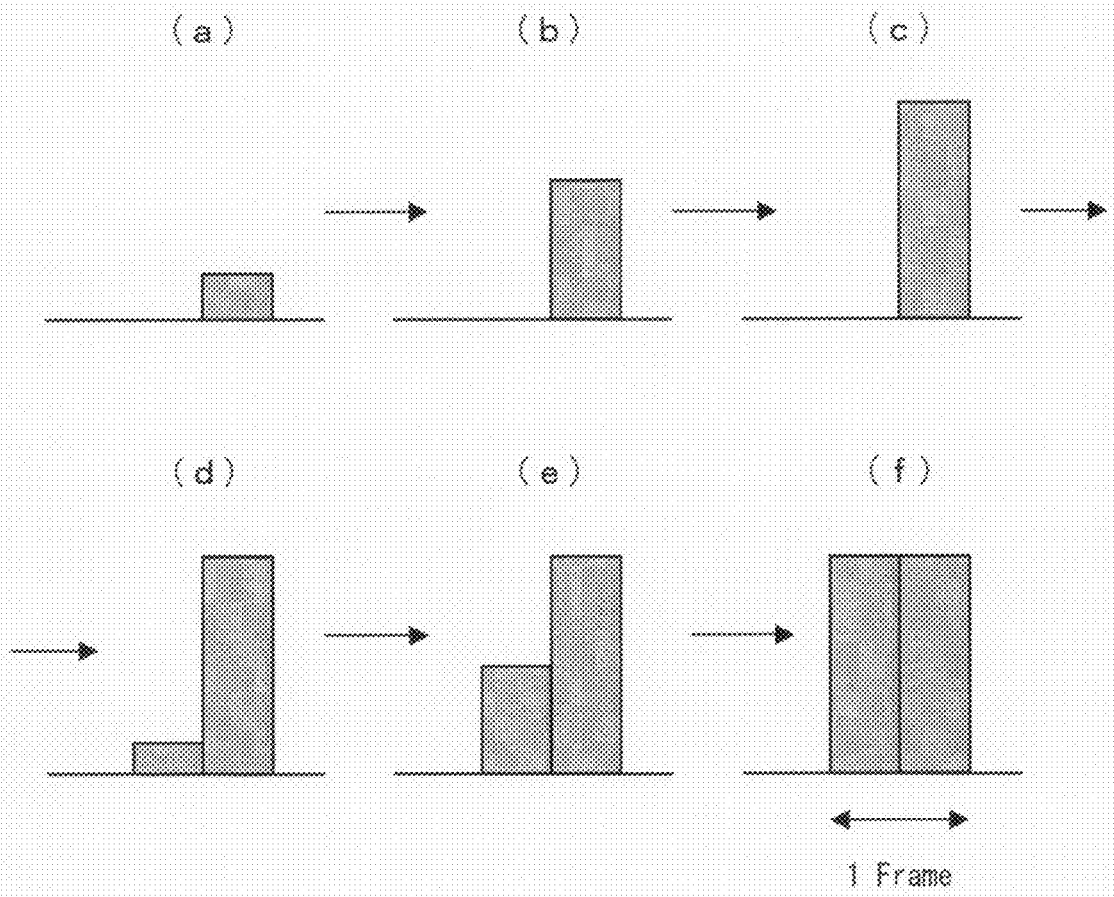
FIG. 23 (*a*) to (*f*) are illustrations of subframe display using two subframes.

To prevent excess brightness in the present display device, when producing a low luminance image display (half the maximum luminance or lower), only the succeeding subframe is used with the preceding subframe being designated for black display as shown in FIGS. 23(*a*) to 23(*f*).

On the other hand, when producing a high luminance image display (higher than half the maximum luminance), the luminance in only the preceding subframe is adjusted with the succeeding subframe being designated for white display.

The relationship between the grayscale level and the luminance of the liquid crystal panel 21 is in accordance with its response characteristics (value of γ) and does not change from one subframe to the next. A relative increase in the luminance with respect to an increase in the grayscale level (rate of increase) is small when the signal grayscale level is low and large when the signal grayscale level is high, as shown in FIG. 19.

Figure 21:
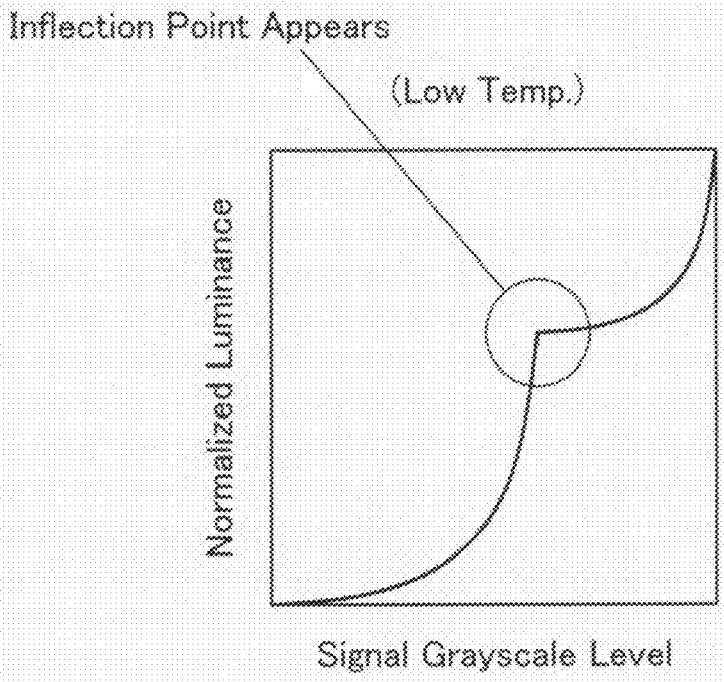
FIG. 21 A graph of a grayscale level-luminance curve with an inflection point for a liquid crystal panel.

Therefore, with simple subframe display, a complete switching of subframes in which luminance outputs are made occurs at a grayscale level where low luminance replaces high luminance or vice versa (switching grayscale level). The rate of increase of the luminance changes greatly at the switching grayscale level, creating an inflection point (singular point) on the grayscale level-luminance curve of the present display device as shown in FIG. 21. Therefore, preferably, the present display device set, to suitable values, the values given by the pre-stage LUT 12 and the post-stage LUT 13 by which image signals are converted to display signals (signal grayscale levels), so that the grayscale level-luminance curve continues smoothly at the switching grayscale level.

The values given by the LUTs 12, 13 are usually set so that the grayscale level-luminance curve is smooth as shown in FIG. 19 when γ=2.2 (about 25° C.).

Figure 22:
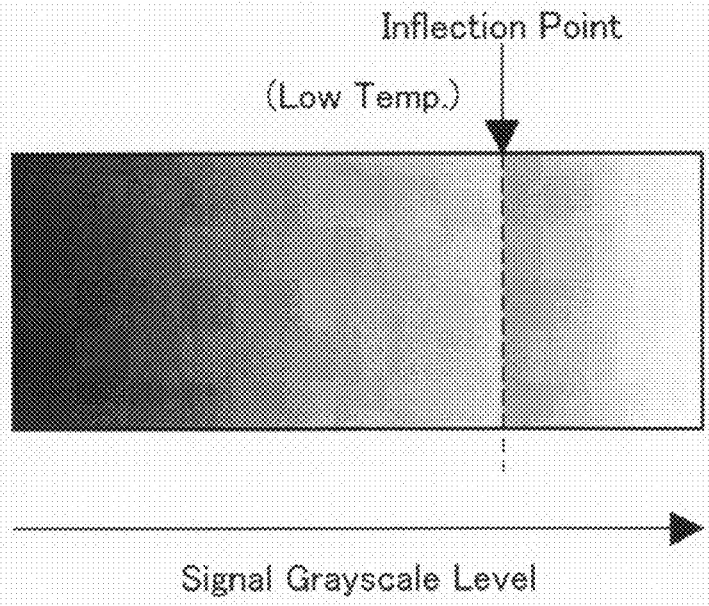
FIG. 22 An illustration of grayscale display produced by a liquid crystal panel, indicating an inflection point.

The value of γ is in accordance with the response characteristics of the liquid crystal panel 21. Therefore, if the response characteristics of the liquid crystal panel 21 change with temperature, the value of γ moves away from 2.2. Using only a pair of LUTs 12, 13 suitable for use at room temperature, when the ambient temperature of the present display device changes, and γ moves away from 2.2, the grayscale level-luminance curve shows an inflection point at a luminance at which a display in the preceding subframe is started (switching grayscale level). In addition, In a case like this, as shown in FIG. 22, the grayscale also shows an anomaly due to the inflection point, failing to produce a natural gradation.

The inflection point can be readily avoided if there are provided more than one pair of LUTs for selective use depending on temperature. However, the structure requires memory for a plurality of LUTs and is costly.

Figure 24:
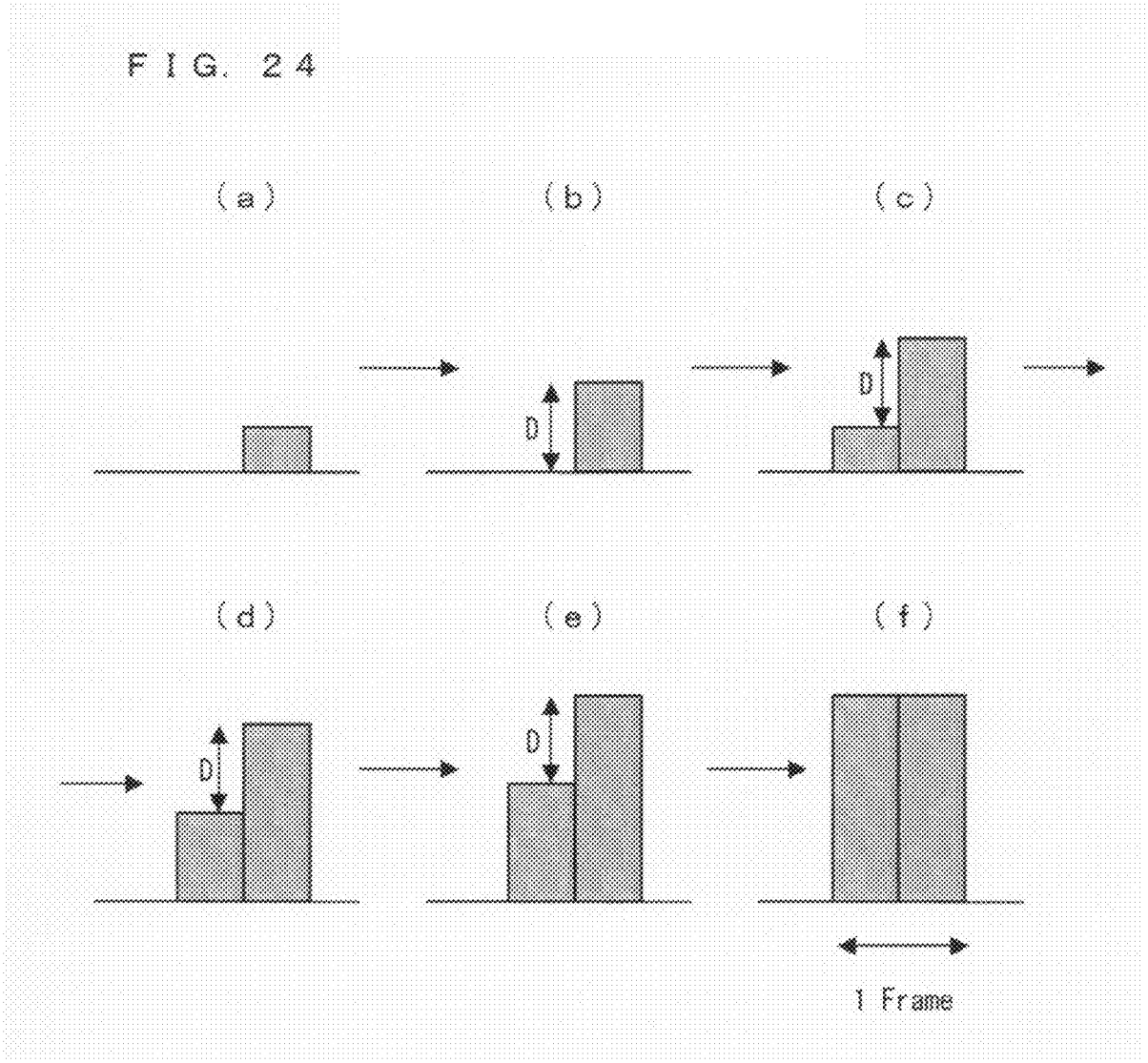
FIG. 24 (*a*) to (*f*) are illustrations of subframe display using two subframes, with the luminance difference between the two subframes being controlled not to grow beyond a predetermined range.

Accordingly, to prevent the occurrence of the inflection point, the present display device preferably controls to confine the difference between the luminance in the preceding subframe and the luminance of the succeeding subframe within a predetermined range. FIGS. 24(*a*) to 24(*f*) show luminance in the preceding subframe and in the succeeding subframe under such control. As depicted in these figures, under the control, the difference between the luminances in the two subframes does not exceed a predetermined range D.

The predetermined range D for the present display device is specified to be a luminance range in accordance with the grayscale levels from 50% or more to 98% or less of the switching grayscale level. For example, if the switching grayscale level is 170, the predetermined range D is a luminance range in accordance with signal grayscale levels 85 to 167.

In this scheme, to achieve a luminance over one frame (frame luminance) that is less than or equal to a given luminance (threshold) D1 within the predetermined range D (low luminance), only the succeeding subframe is used to produce a display, with the preceding subframe being designated for black display.

In contrast, to achieve a frame luminance that is greater than D1 and less than or equal to Maximum Luminance−D1 (intermediate luminance), both the luminances in the preceding subframe and the succeeding subframe are adjusted. The difference between the luminances in the two subframes is controlled to remain within D until the luminance in the succeeding subframe reaches the maximum (white display).

If D1<Frame Luminance≦D1+d, the luminance D1 is output in the succeeding subframe, and the remaining luminance is output in the preceding subframe. If D1+d<Frame Luminance≦D1+2d, the luminance D+d is output in the succeeding subframe, and the remaining luminance is output in the preceding subframe. d is a given step value such that D1+d is within the range D. Under the control, the difference between the luminances in the two subframes either D1 or D1+d.

If the frame luminance equals to exceeds Maximum Luminance−(D1+d) (high luminance), the luminance in the succeeding subframe is a maximum (white display). Therefore, if the frame luminance is even greater, the luminance in only the preceding subframe is adjusted to produce a display, with the succeeding subframe being designated for white display.

Under the control, the luminances of the two subframes alternately increases with respect to an increase in the signal grayscale level at intermediate luminances. That is, the luminance with a high rate of increase in the succeeding subframe (rate of increase; relative increase in the luminance with respect to an increase in the grayscale level) the luminance with a low rate of increase in the preceding subframe can co-exist (the two luminances can be alternately increased with respect to an increase in the signal grayscale level for every step value d).

Figure 25:
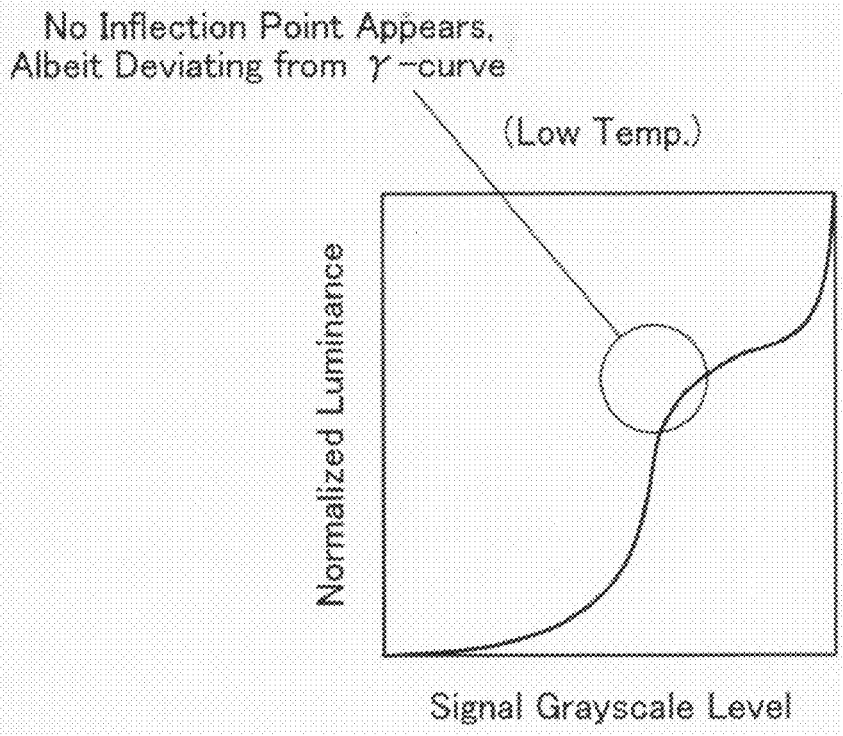
FIG. 25 A graph of a grayscale level-luminance curve with no inflection point for a liquid crystal panel.
Figure 26:
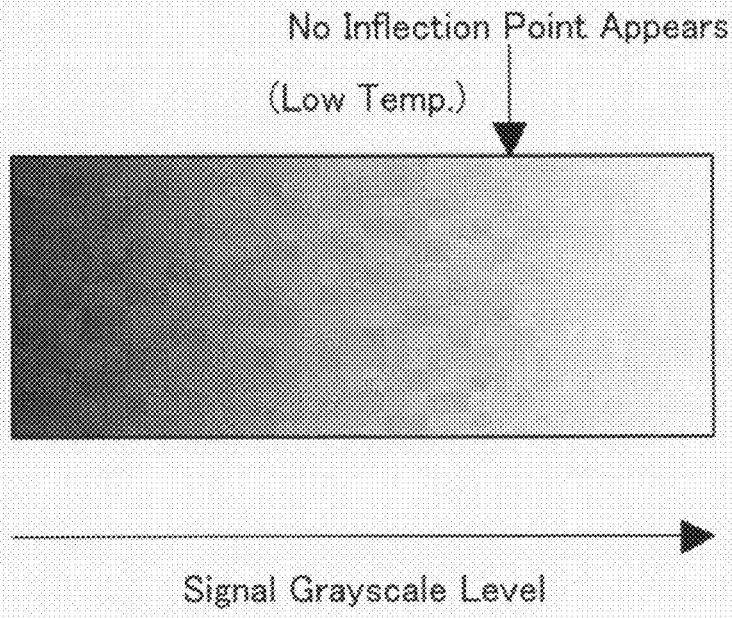
FIG. 26 An illustration of grayscale display produced by a liquid crystal panel, indicating disappearance of the inflection point.

Thus, the grayscale level-luminance curve of the present display device can be rendered as shown in FIG. 25. The curve does not agree with the γ-curve shown in FIG. 19. However, the co-existence of luminances of different rates of increase at intermediate luminances (around the switching grayscale level) rounds off the sharp bend of the curve as shown in FIG. 25. The inflection point (singular point) disappears, and a natural grayscale display is achieved as shown in FIG. 26.

If the step value d is set to a small value, the two luminances are mixed finely with smaller intervals. That further eases the sharpness of the grayscale level-luminance curve and reliably prevents an occurrence of the inflection point. Thus, the step value d is preferably set to a smallest value possible (for example, the luminance equivalent to one to three grayscale units).

In the foregoing description, the luminances in the two subframes are alternately increased with respect to an increase in the signal grayscale level for every step value. However, the difference between the luminances in the two subframes may be controlled only to remain within D without using the step value (without the alternate increases). The scheme is also capable of increasing the luminances in the two subframes with respect to an increase in the frame luminance (the luminances in the two subframes can co-exist) at intermediate luminances. Therefore, the scheme restrains an occurrence of the inflection point.

In the foregoing description, the predetermined range D is specified to be a luminance range in accordance with the grayscale levels from 50% or more to 98% or less of the switching grayscale level. If the lower limit of D is too small, the subframe display is less effective in reducing excess brightness. If the upper limit of D is close to the luminance corresponding to the switching grayscale level, the inflection point is not well restrained. These points are preferably considered in determining the upper and lower limits of D.

Nevertheless, more simply, the difference between the luminances in the two subframes may be only made smaller than the luminance corresponding to the switching grayscale level (half the maximum of the frame luminance). The scheme is also capable of restrains an occurrence of the inflection point. In the foregoing description, the grayscale level 170 is taken as an example of the switching grayscale level. The value however may vary with the properties of the liquid crystal material for the liquid crystal panel 21 (e.g., response rate).

In the foregoing description, the preceding subframe is designated for black display and the luminance in the succeeding subframe is adjusted to produce a low luminance display. Meanwhile, to produce a high luminance display, the succeeding subframe is designated for white display and the luminance in the preceding subframe is adjusted.

This is however not the only possibility. The preceding and succeeding subframes may switch their roles. Specifically, the succeeding subframe may be assigned for black display and the luminance in the preceding subframe may be adjusted to produce a low luminance display, whist to produce a high luminance display, the preceding subframe may be assigned for white display and the luminance in the succeeding subframe may be adjusted.

In other words, the subframe assigned for black display (white display) to produce a low luminance (high luminance) display may be either the preceding subframe or the succeeding subframe. This is applicable also to cases where the difference between the luminances in the two subframes is confined within D to prevent an occurrence of the inflection point.

In the description so far, all processing in the present display device is done under the control of the control section 15. This is however not the only possibility. Computer programs for the implementation of the processing may be stored in a storage medium, and an information processing device capable of reading the programs may replace the control section 15.

In the structure, a computing device (CPU, MPU, etc.) in the information processing device reads the programs from the storage medium and executes the processing. In other words, the programs per se realize the processing.

The information processing device may be, apart from a general computer (workstation, personal computer, etc.), an extension board or an extension unit attached to a computer.

The computer program is software program code (executable program, intermediate code program, source program, etc.) which implements the processing. The program may be used alone or in combination with another program (e.g., OS). The program may be read from a storage medium, temporarily loaded into memory (e.g., RAM) in the device, and read again from the memory for execution.

The storage medium in which the program is stored may be readily separable from the information processing device or fixed (attached) to the device. Alternatively, the storage medium may be an external storage device connectable to the information processing device.

Examples of such a storage medium include magnetism tapes, such as video tapes and cassette tapes; magnetism disks, such as, Floppy® disks and hard disks; optical discs (magneto-optical discs), such as CD-ROMs, MOs, MDs, DVDs, and CD-Rs; memory cards, such as IC cards and optical cards; and semiconductor memories, such as mask ROMs, EPROMs, EEPROMs, and flash ROMs.

The storage medium may be connected to the information processing device over a network (Intranet, Internet, etc.). In a case like this, the information processing device obtains the programs by downloading them over the network. In other words, the programs may be obtained over a transmission medium (which carries the program in a flowing manner) such as a network (either wired or wireless). A download program is preferably contained in the device (or transmission end device or receiving end device) in advance.

The present invention could be described as follows. The invention relates to a grayscale luminance display method for a TFT liquid crystal display device in which a pixel in a panel carries out grayscale luminance display. The method is a driving method whereby each frame is divided into two subframes to produce a display to improve moving image display capability, viewing angle characteristics, etc. The first of the two subframes is set to a minimum luminance, and the grayscale level is changed in the other, second subframe to produce a grayscale luminance display, up to half a maximum luminance display. On the other hand, when the display luminance is half a maximum luminance or higher, the luminance in the first subframe is changed to produce a grayscale luminance display. This display driving method (see FIG. 23) is expected to improve moving image capability and viewing angle characteristics.

However, the display method, applied to a liquid crystal panel, entails following inconveniences. The liquid crystal panel changes its response characteristics with temperature. Its grayscale display luminance changes with temperature if the driving method is applied (see FIG. 21). The display grayscale luminance may be set so that $\gamma=2.2$ at room temperature (see FIG. 19). $\gamma$ however changes from 2.2 when temperature falls or rises (see FIG. 21). The driving method divides each frame into two subframes. When the luminance in the two subframes display is reached from one of two luminance display grayscale levels, the temperature characteristics of its grayscale luminance characteristics change. Therefore, grayscale level change changes at that grayscale level output, creating an inflection point (see FIG. 22). The change of $\gamma$ from 2.2 of course changes the impression of an image. A rapid change of the grayscale level change is more serious.

To solve this, a method exists whereby signals for a preceding subframe display and a succeeding subframe display are changed at temperatures for output. That however requires a temperature sensor and an output table for each temperature, thus additional cost. Therefore, the problems are preferably solved by outputting a grayscale luminance display signals so as not to reach or exceed difference between display luminances in subframe frame periods (see FIG. 24). Implementing the display driving method eliminates the inflection point and produces an apparently smooth grayscale display (see FIGS. 25, 26).

In a display driving method for a TFT liquid crystal panel whereby each frame is divided into two subframes, in a method of producing a grayscale luminance display for one frame by a sum luminance of pixels in individual subframes, the TFT liquid crystal panel of the present invention could be described as a TFT liquid crystal panel (module, monitor, TV) which produces such a display that difference in the display luminances between the subframe periods in one frame display does not (relatively) reach or exceed a threshold value.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention is suitable for applications to devices with a display screen in which an excess brightness phenomenon may occur.

The invention claimed is:

1. A display device displaying an image by dividing each frame into two subframes, including a first subframe and a second subframe, said display device comprising:

a display section configured to display an image, with luminance in accordance with a luminance grayscale level represented by an incoming display signal; and a control section configured to generate a first display signal and a second display signal for the first and second subframes, to alternately output the first and second display signals to the display section, and to control to output the display signals twice per frame period so that the dividing of the frames does not change a frame luminance which is an average luminance output of a pixel within the display section in one frame, wherein if the display of one frame in the display section is not white, the control section is configured to create a difference between luminance outputs in the two subframes and sets the luminance difference to a value less than a a sub-maximum luminance, the sub-maximum luminance being equal to a luminance of a subframe for a white display;

the control section, if the frame luminance is less than or equal to a predetermined threshold, designates the first subframe for black display in which luminance is a minimum luminance and adjusts luminance for the second subframe to produce a display, and if the frame luminance is greater than the threshold, sets the difference between the luminance outputs in the two subframes to a value less than the sub-maximum luminance;

the threshold is set to a value less than the sub-maximum luminance: and the threshold is set to a luminance range in accordance with luminance grayscale levels from 50% to 98% of a luminance grayscale level in accordance with the sub-maximum luminance.

2. The display device of claim 1, wherein the display section is a liquid crystal panel.

3. A liquid crystal monitor, comprising:

the display device of claim 2; and a signal feeder section for transferring externally supplied image signals to the control section, wherein the control section in the display device generates the display signals from the image signals.

4. A liquid crystal television receiver, comprising:

the display device of claim 2; and a tuner section for selecting a channel for television broadcast signals and transferring television image signals for the selected channel to the control section, wherein the control section in the display device generates the display signals from the television image signals.

5. A method of displaying an image by dividing each frame into two subframes, including a first subframe and a second subframe, said method comprising: the step of generating a first display signal and a second display signal for the first and second subframes , alternately outputting the first and second display signals to a display section, and outputting the display signals twice per frame period so that the dividing of the frames does not change a frame luminance which is an average luminance output of a pixel within the display section in one frame, wherein if the display of one frame in the display section is not white, the step creates a difference between luminance outputs in the two subframes and sets the luminance difference to a value less than a sub-maximum luminance, the sub-maximum luminance being equal to a luminance of a subframe for a white display;

if the frame luminance is less than or equal to a predetermined threshold, the first subframe for black display in which luminance is a minimum luminance is designated and luminance for the second subframe to produce a display is adjusted, and if the frame luminance is greater than the threshold, the difference between the luminance outputs in the two subframes is set to a value less than the sub-maximum luminance: the threshold is set to a value less than the sub-maximum luminance: and the threshold is set to a luminance range in accordance with luminance grayscale levels from 50% to 98% of a luminance grayscale level in accordance with the sub-maximum luminance.

6. The display device of claim 1, wherein when the first and second subframes have a ratio of n:1, n being a real number greater than or equal to 1, the control section: designates the first subframe for a minimum luminance and adjusts display luminance for only the second subframe, for grayscale display to set an integral luminance per frame to (Minimum Luminance+Luminance of Second Subframe)/(n+1) if the frame luminance is equal to or less than 1/(n+1) times a maximum luminance which is the threshold; and designates the second subframe for a maximum luminance and adjusts display luminance for the first subframe, for grayscale display to set an integral luminance per frame to (Luminance of First Subframe+Maximum Luminance)/(n+1) if the frame luminance is equal to or more than 1/(n+1) times the maximum luminance.

* * * * *